US010984775B2

(12) United States Patent
Elmvang et al.

(10) Patent No.: US 10,984,775 B2
(45) Date of Patent: Apr. 20, 2021

(54) LIGHT FIXTURE FOR ABSORBING SOUND ENERGY

(71) Applicant: Fischer Lighting Holding ApS, Vanløse (DK)

(72) Inventors: Stig Elmvang, Skovlunde (DK); Tim Magnusson, Vanløse (DK)

(73) Assignee: Fischer Lighting Holding APS, Vanlose (DK)

( * ) Notice: Subject to any disclaimer, the term of this patent is extended or adjusted under 35 U.S.C. 154(b) by 0 days.

(21) Appl. No.: 16/827,262

(22) Filed: Mar. 23, 2020

(65) Prior Publication Data

US 2021/0090542 A1 Mar. 25, 2021

Related U.S. Application Data

(63) Continuation-in-part of application No. PCT/EP2019/075532, filed on Sep. 23, 2019.

(51) Int. Cl.

| | |
|---|---|
| ***G10K 11/162*** | (2006.01) |
| ***F21V 15/01*** | (2006.01) |
| ***F21V 7/10*** | (2006.01) |
| ***F21V 21/104*** | (2006.01) |
| ***F21S 8/06*** | (2006.01) |

(Continued)

(52) U.S. Cl.

CPC ..... *G10K 11/162* (2013.01); *F21S 8/061* (2013.01); *F21V 7/10* (2013.01); *F21V 15/01* (2013.01); *F21V 21/104* (2013.01); *F21Y 2105/18* (2016.08); *F21Y 2115/10* (2016.08)

(58) Field of Classification Search

CPC ..... G10K 11/162; F21V 21/104; F21V 15/01; F21V 7/10; F21S 8/061; F21Y 2115/10; F21Y 2105/18; F01N 2210/00; F01N 2230/00

See application file for complete search history.

(56) References Cited

U.S. PATENT DOCUMENTS

| | | | |
|---|---|---|---|
| 5,363,295 | A | 11/1994 | DeKleine et al. |
| 5,673,997 | A | 10/1997 | Akiyama |

(Continued)

FOREIGN PATENT DOCUMENTS

| | | | |
|---|---|---|---|
| DE | 19608583 | A1 | 9/1996 |
| EP | 0909919 | A2 | 4/1999 |

(Continued)

*Primary Examiner* — Joseph L Williams
*Assistant Examiner* — Jose M Diaz
(74) *Attorney, Agent, or Firm* — Dinsmore & Shohl LLP

(57) ABSTRACT

The present disclosure relates to a light fixture for absorbing sound energy. The light fixture is composed of a body comprising a set of discs and a set of supporting elements. As an example, the discs may be annular discs with a central opening for receiving a lamp fitting and/or a reflector. The supporting elements may be pillars that are fixedly attached to the discs e.g. using a plurality of fittings. The discs may comprise a sound absorbing material, such that the light fixture is suitable for absorbing sound energy. This is particularly useful in large indoor environments such as open offices, lobbies, halls, and auditoriums, which all benefit from improved acoustics. The light fixture may comprise two or more light sources, e.g. for distributing light both radially and downwards. In one embodiment, the light fixture is a pendant light.

20 Claims, 19 Drawing Sheets

(51) Int. Cl.
*F21Y 105/18* (2016.01)
*F21Y 115/10* (2016.01)

(56) References Cited

U.S. PATENT DOCUMENTS

| | | | | |
|---|---|---|---|---|
| 10,779,478 | B2 * | 9/2020 | Golle | F21V 23/003 |
| 2005/0168986 | A1 | 8/2005 | Wegner | |
| 2010/0110674 | A1 * | 5/2010 | Hysky | F21V 33/006 362/234 |
| 2013/0201690 | A1 * | 8/2013 | Vissenberg | F21V 33/006 362/296.07 |
| 2015/0109765 | A1 * | 4/2015 | Sepkhanov | F21V 29/83 362/147 |
| 2017/0044761 | A1 * | 2/2017 | Flotre | G10K 11/162 |
| 2017/0248290 | A1 | 8/2017 | Uhler | |
| 2018/0336875 | A1 * | 11/2018 | Patterson | F21V 21/008 |
| 2019/0088241 | A1 * | 3/2019 | Czech | F21V 21/112 |
| 2019/0295519 | A1 * | 9/2019 | Krass | G10K 11/172 |

FOREIGN PATENT DOCUMENTS

| | | | |
|---|---|---|---|
| EP | 3242071 | B1 | 11/2019 |
| GB | 2313184 | A | 11/1997 |
| GB | 2326467 | A | 12/1998 |
| WO | 9812472 | A1 | 3/1998 |
| WO | 2014053145 | A1 | 4/2014 |

* cited by examiner

LIGHT FIXTURE FOR ABSORBING SOUND ENERGY

CROSS-REFERENCE TO RELATED APPLICATION

This application is a Continuation-in-part of International Application No. PCT/EP2019/075532 filed Sep. 23, 2019, the entire content of which is incorporated herein by reference.

FIELD OF THE INVENTION

The present disclosure relates to a light fixture for absorbing sound energy.

BACKGROUND OF THE INVENTION

Light fixtures exist in various types, designs and sizes. Examples of light fixture types include freestanding lamps such as floor lamps, and fixed lamps which can be further grouped in recessed lights and surface-mounted lights. In case of recessed lights, the protective housing is often concealed behind a ceiling or wall, leaving only the fixture itself exposed. The ceiling-mounted version is often called a downlight. For surface-mounted lights, the finished housing is exposed, i.e. not flush with the surface. Examples include chandeliers and pendant lights. The present disclosure relates to light fixtures, in particular downlights and pendant lights.

The acoustics of a room is typically determined by many parameters such as the size of the room, the amount of furniture in the room, the materials used in the room, the orientation of reflecting surfaces, etc. Many indoor environments, especially large rooms, typically need to be designed with the acoustics in mind in order to ensure a pleasant environment. Examples include open offices, lobbies, halls, auditoriums, and restaurants, all of which benefits from improved acoustics. Typically, these types of indoor environments also need a large number of light fixtures to ensure proper lighting.

Hence, there is a need for a light fixture with acoustic properties that reduce reverberation in the environment of the light fixture. Furthermore, there is a need for a light fixture with improved acoustic properties that distribute the light uniformly.

SUMMARY OF THE INVENTION

The presently disclosed light fixture 1 addresses the above needs of improved acoustic properties in combination with improved lighting from the light fixture. This is done by providing a light fixture body 2 comprising at least one material suitable for absorbing sound. The body preferably comprises a plurality of discs 12 held together by a number of supporting elements 18. The plurality of discs 12 serve the purpose of increasing the surface area of the light fixture body 2, such that a larger amount of sound energy may be absorbed. The improved acoustic properties of the light fixture 1 may be beneficial e.g. at restaurants where it is typically desired that people can have a conversation at the dinner table without too much background noise from neighbouring tables. It could also be useful in an office, especially an open-plan office space. Other large rooms such as lobbies, halls, and auditoriums may likewise benefit from the light fixture 1.

Preferably, each disc comprises a sound absorbing material 17 for absorbing sound energy. The discs 12 are preferably separated by a gap, which serves two purposes. First, the surface area is increased since a larger area of the disc is available for sound absorption as opposed to if the discs 12 were stacked with no gap in between. Second, the gap between the discs 12 allows light to escape through the gap in order to allow a radial light distribution from the light fixture 1. The light fixture 1 may further accommodate a lamp fitting 6 for receiving a light source, and a reflector 10 for reflecting the light from said light source. The reflector 10 may preferably be attached to said lamp fitting 6, e.g. via threaded engagement. The light fixture 1 may comprise two or more light sources. In this case, a first light source 3 may distribute light primarily downwards, which may be achieved in combination with the aforementioned reflector 10. A second light source 4 may facilitate a radial light distribution through the gaps of the discs 12. The two light sources (3, 4) may be controlled independently e.g. through a lighting control system. For example, the two light sources may have different colours, colour temperatures, or brightness.

The presently disclosed light fixture 1 is compatible with a number of components described in other applications by the applicant, said components including among others a lamp fitting 6 and a reflector 10. An example of a lamp fitting is disclosed in WO 2014/053145 by the applicant, which is hereby enclosed by reference in its entirety. In WO 2014/053145 the presently disclosed lamp fitting 6 is exemplified as a "main body". A compatible reflector 10 is described in international application PCT/EP2019/075532.

The presently disclosed light fixture 1 may be provided in various types of different shapes and sizes, which is also evident from the accompanying drawings. A first aspect of the present disclosure relates to a surface-mounted light fixture intended as a new instalment. The light fixture 1 may be of any type, such as a pendant or a downlight. A second aspect of the disclosure relates to a downlight suitable for retro-fitting to an existing lamp housing 22 that is countersunk into a ceiling 23. The downlight is further described in PCT/EP2019/075532. In the second aspect, the existing lamp housing 22 is recessed behind the ceiling 23 or wall, while the reflector 10 and the sound absorbing material 17 is visible from below.

Accordingly, the present disclosure relates to a light fixture 1 for absorbing sound energy, the light fixture 1 comprising: a lamp fitting 6 configured for receiving a first light source 3; a reflector 10 for reflecting light from the first light source 3, the reflector 10 comprising a top section configured for attachment to a bottom section of the lamp fitting 6; and a body comprising a set of discs 12, wherein a plurality of the discs 12 have at least one opening 15 configured for receiving the lamp fitting 6; and a set of supporting elements 18 configured for holding the set of discs 12 such that the set of discs 12 are separated by a predefined gap, wherein at least one of the discs 12 and/or one of the supporting elements 18 comprise a sound absorbing material 17.

DETAILED DESCRIPTION OF THE INVENTION

Definitions

Figure 1:
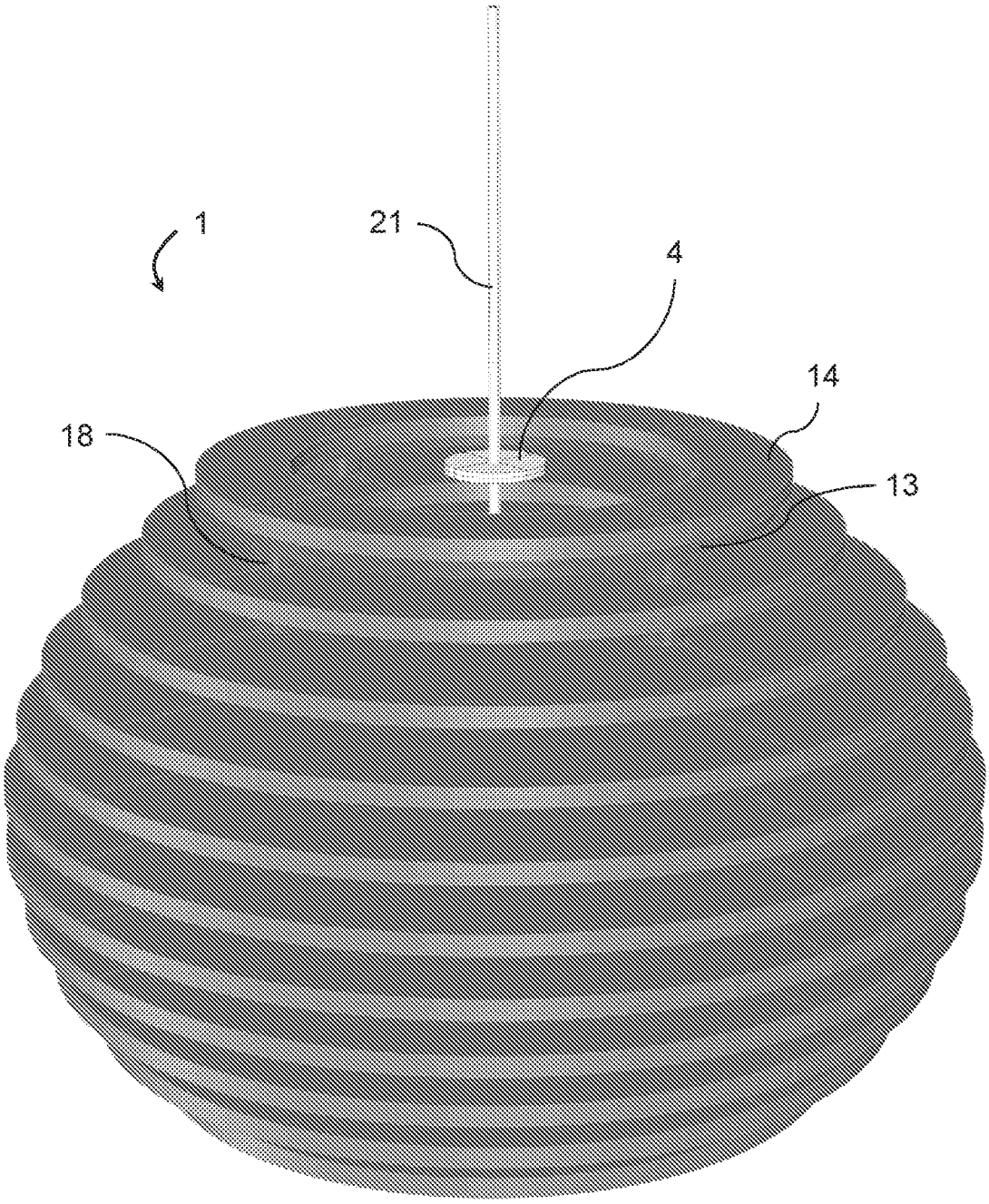
FIG. 1 shows a light fixture 1 according to an embodiment of the present disclosure. This embodiment comprises a set of discs 12 with a predefined gap in between. The outer surface of the light fixture 1 resembles a compressed sphere.
Figure 2:
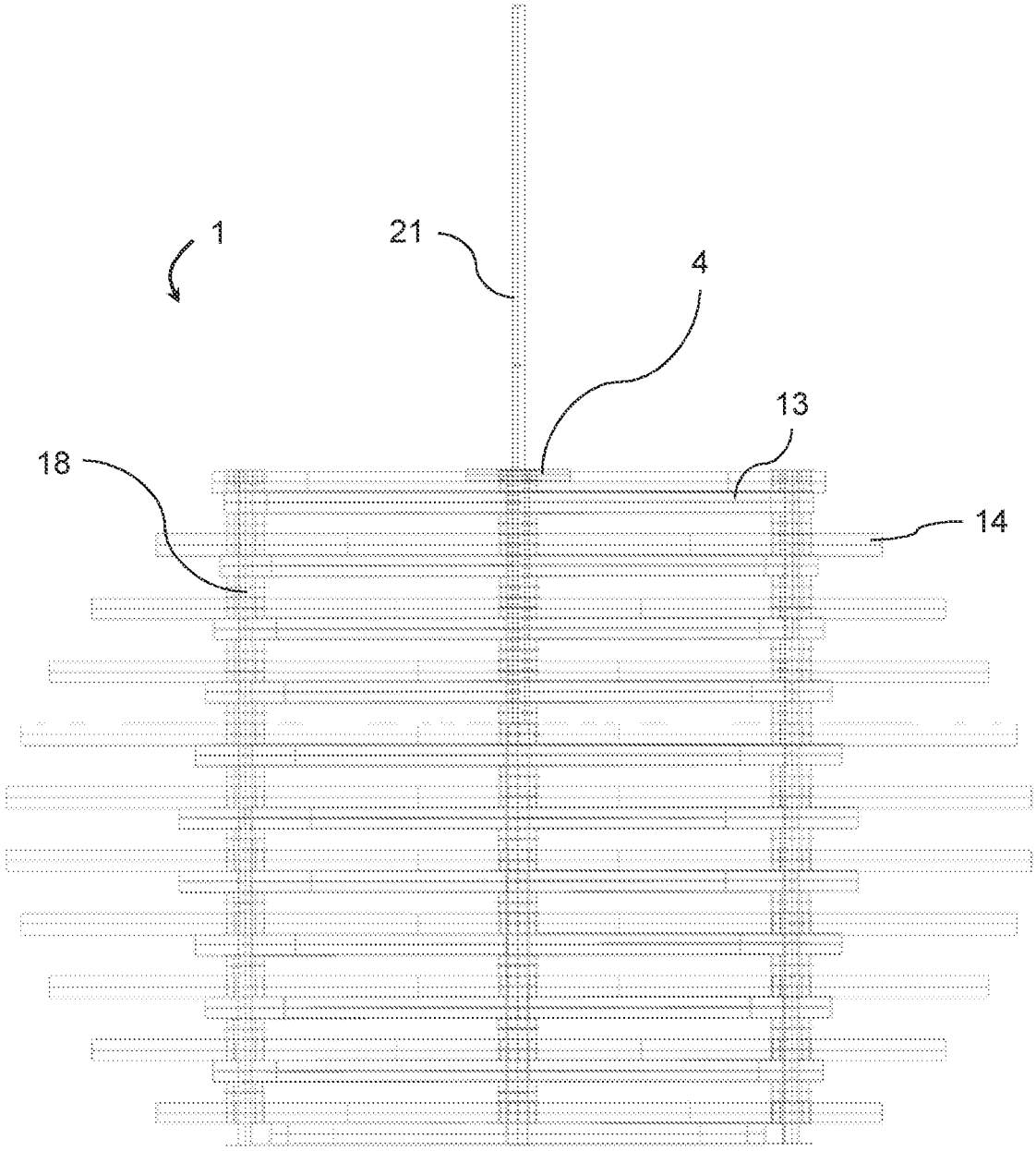
FIG. 2 shows a cross-section of the light fixture shown in FIG. 1. It is a vertical cross-section going through the central axis of the light fixture (the chord 21 is placed along the central axis).

A body in the present context is understood to be the main structural part of an object.

A disc in the present context is understood to be an object wherein the thickness of the object is smaller than the other dimensions defining said object. Therefore, a disc should not be limited to circular or rounded objects defined by a thickness and a radius. Herein, a disc may also refer to a plate of arbitrary geometry, e.g. a square plate or a hexagonal plate.

A supporting element in the present context is understood to be any physical element suitable for contributing to the support of a structure.

A lamp fitting in the present context is understood to be a device for mechanically supporting a light source.

A reflector in the present context is understood to be a device for reflecting light from a light source.

A sound absorbing material in the present context is understood to be a material suitable for acoustic absorption.

DETAILED DESCRIPTION OF THE INVENTION

The present disclosure relates to a light fixture for absorbing sound energy in the environment of the light fixture.

The light fixture comprises a lamp fitting 6 configured for receiving a first light source 3, a reflector 10 for reflecting light from the first light source 3, and a body comprising a set of discs 12 and a set of supporting elements 18.

Lamp Fitting

The lamp fitting 6 is configured for receiving at least a first light source 3. Preferably, the lamp fitting 6 serves multiple purposes in addition to holding the light source. Some light sources develop a large amount of heat when used. Therefore, the lamp fitting 6 should preferably comprise means for transporting heat away from the light source. An example of such heat transporting means is a heat sink. Therefore, the lamp fitting 6 may further comprise a plurality of radially extending fins 7. The fins 7 may extend from the lamp fitting 6 body, such that the lamp fitting 6 also acts as a cooling element. An example of such a lamp fitting 6/cooling element is disclosed in EP 3 242 071 B1 by the same applicant, which is hereby enclosed by reference in its entirety.

Figure 14:
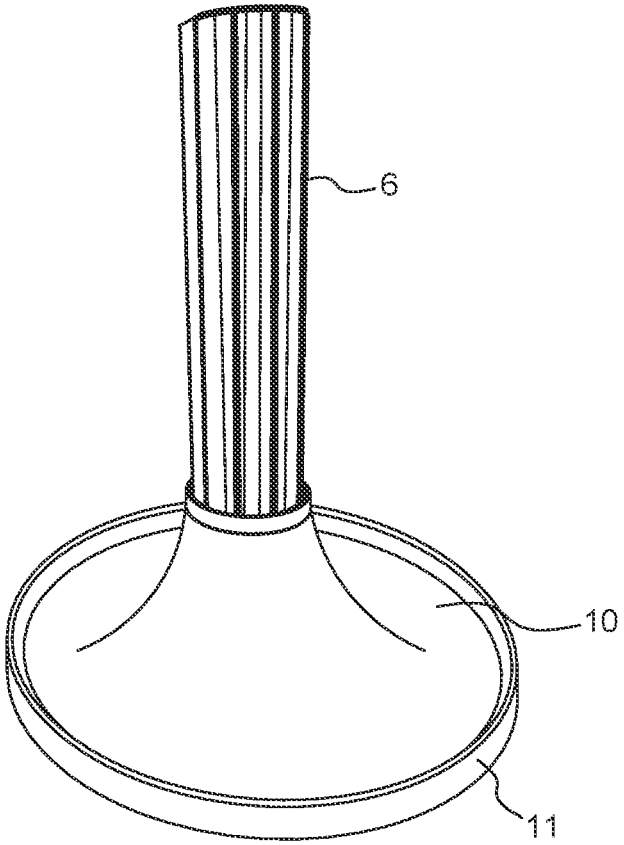
FIG. 14 shows a picture of a reflector 10 attached to a lamp fitting 6. The two components are attached via threaded engagement.

The lamp fitting 6 may be of a long type, such that it spans a majority of the light fixture in the vertical direction. The lamp fitting 6 may comprise a cylindrical body. The body may be hollow. Preferably, the lamp fitting 6 comprises a thread on at least a part of the outer surface. The lamp fitting 6 may also comprise a thread on a majority of its outer surface. The lamp fitting 6 may preferably be configured for threaded engagement with the reflector 10. In case the lamp fitting 6 comprises a plurality of radially extending fins 7, these may preferably be provided with a thread on the outer edge, such that the lamp fitting 6 is configured for threaded engagement with a reflector 10. This is shown in FIG. 14, which shows a reflector 10 attached to the lamp fitting 6 via threaded engagement. As an example, the lamp fitting 6 may comprise ten fins 7. The lamp fitting 6 may further comprise a plurality of apertures such that light may escape from the inner of the lamp fitting 6 to the outside through said apertures. In this case, the second light source 4 may be configured for distributing light through the apertures of the lamp fitting 6. This may be achieved by configuring the second light source 4 such that the light is led into the hollow cylinder of the lamp fitting 6.

Reflector

Figure 12A:
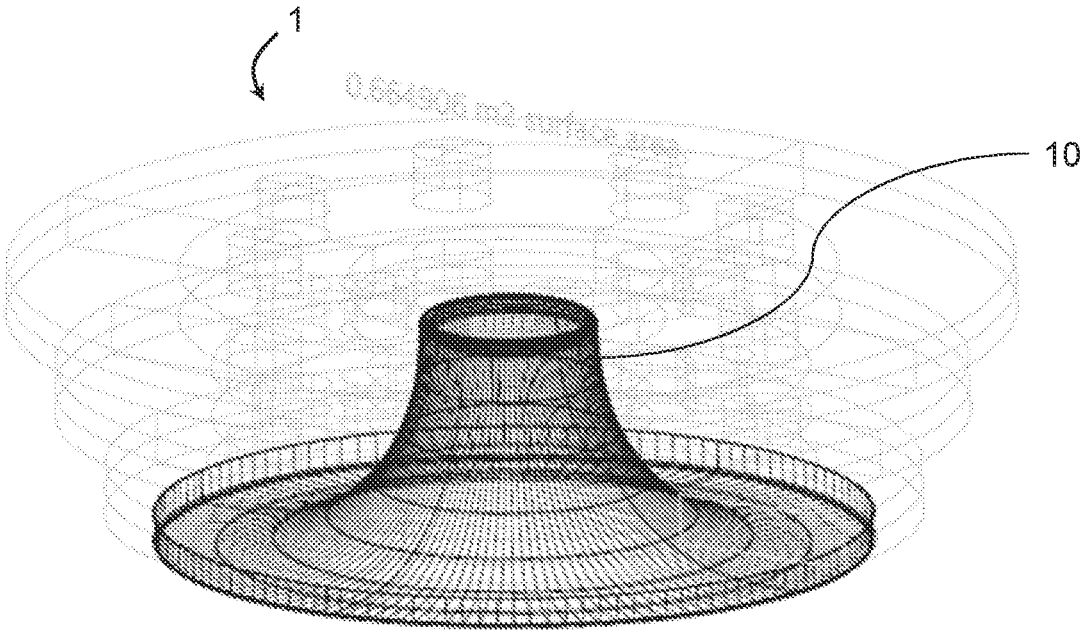
FIG. 12A-12B show in perspective two embodiments of a light fixture 1 according to the present disclosure, wherein the outer radius of the discs 12 are varied such that the light fixture body 2 has the shape of a bowl. The two embodiments comprise a different amount of discs 12 and consequently the light fixture body 2 has a different surface area between the two embodiments.
Figure 12B:
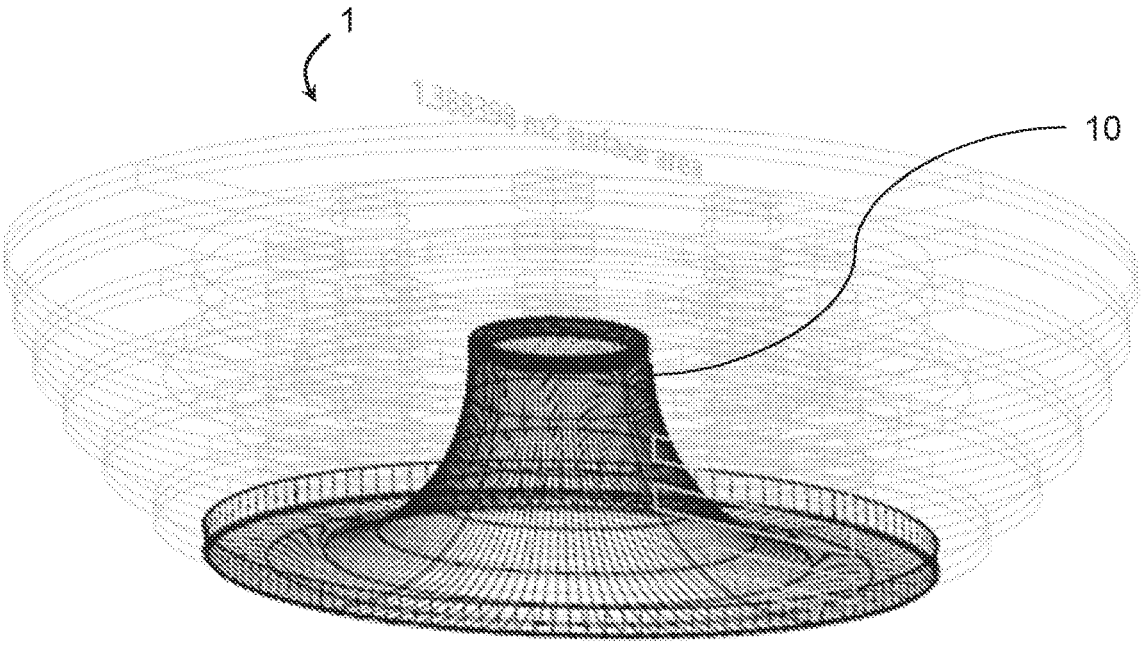

Typically, light fixtures or lamps comprise a reflector for reflecting the light from a light source housed inside said reflector. In order to facilitate this purpose, the lamp fitting 6 preferably comprises means for attaching a reflector 10 to the lamp fitting 6. The reflector 10 may be attached mechanically, magnetically, or otherwise to the lamp fitting 6. As an example, the lamp fitting 6 may comprise an outer thread configured for engaging with the reflector 10. The top section of the reflector 10 may comprise an inner thread configured for engaging with the lamp fitting 6. Hence, the bottom part of the lamp fitting 6 and the top section of the reflector 10 may be configured for threaded engagement. At least a part of the shape of the reflector 10 may be convex when viewed from below. The reflector 10 may be rotationally symmetric. Furthermore, the reflector 10 may comprise an upwards extending rim 11 at the bottom of the reflector 10 as shown in FIG. 12A. The rim 11 may be configured for mechanically engaging with a bottom disc. An example of a reflector 10 is disclosed in PCT/EP2019/075532 by the same applicant. Preferably, the reflector 10 described herein is compatible with the presently disclosed light fixture.

Set of Discs

The light fixture body 2 comprises a set of discs 12 and a set of supporting elements 18 for holding said discs 12. A disc should be construed as a predominantly flat geometrical object of arbitrary shape, wherein the thickness of the object is less than the extent of the object in the other dimensions defining said object. As an example, the discs 12 may be annular discs 12, each disc defined by a first radius $R_1$ and a second radius $R_2$. The discs 12 may be further defined by a thickness t. The first radius, also denoted the inner radius, is measured from the center of the disc to the inner edge of the disc. Thus, the first radius defines a central opening 15 in the disc. The second radius, also denoted the outer radius, is measured from the center of the disc to the outer edge of the disc. The outer radius may be varied such that the edges of the discs 12 follow a convex shape when the light fixture is viewed in cross-section. Hence, the set of discs 12 may comprise a plurality of annular discs 12. The first and second radii may have different values among the discs 12 in the set of discs in order to create a 3-dimensional object with a predefined size and shape. The discs may also be defined by an inner circumference and an outer circumference, wherein the inner circumference defines an opening 15 in the disc.

The set of discs 12 preferably comprises a plurality of discs, such as 2-3 discs, or 4-6 discs, or 7-11 discs, or more discs than 11. The discs 12 may have various geometries such as circular, rounded, oval, elliptical, square, rectangular, hexagonal, or other geometries. The discs 12 may also have more complex geometries, e.g. defined by parametric equation(s). As an example, the discs 12 may comprise a multi-lobed structure (e.g. comprising three lobes). The discs 12 in the set of discs are preferably stacked or separated by a gap. Preferably, there is a gap between each neighbouring pair of discs 12 in the set of discs, since this facilitates a large surface area and simultaneously allows light to be distributed from the inner of the light fixture to the outside through said gap. Accordingly, while each disc is predominantly a flat object, multiple discs 12 may be combined to form a 3-dimensional structure, in the present context a 3-dimensional light fixture body 2. Hence, by combining discs 12 of various shapes and sizes, there are endless possibilities regarding the design of the light fixture body 2 as exemplified by FIGS. 6A-6D.

Figure 3A:
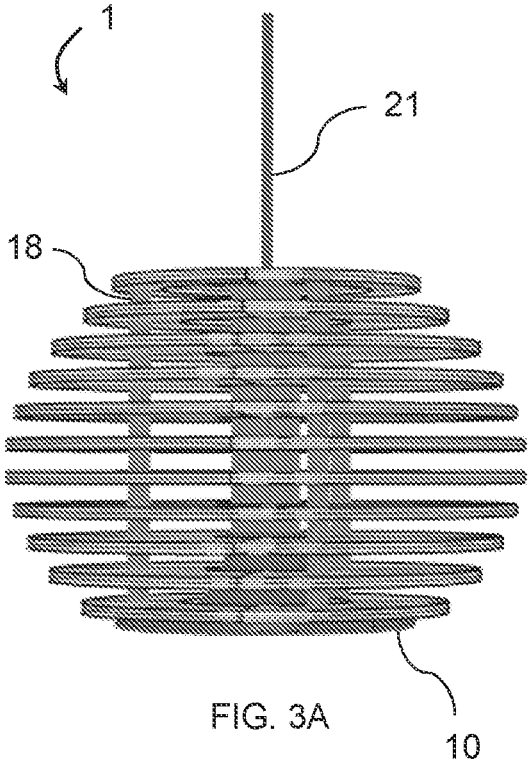
FIG. 3A shows a light fixture according to an embodiment of the present disclosure, wherein the light fixture body 2 comprises three pillars as supporting elements 18. The reflector 10 and the supporting elements 18 are visible through the gap in the discs 12.
Figure 3B:
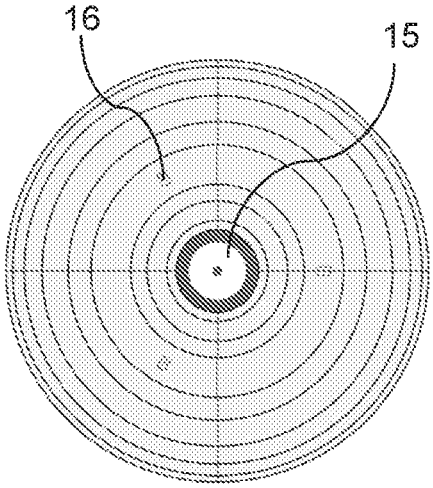
FIG. 3B shows a top view of the light fixture shown in FIG. 3A.
Figure 3C:
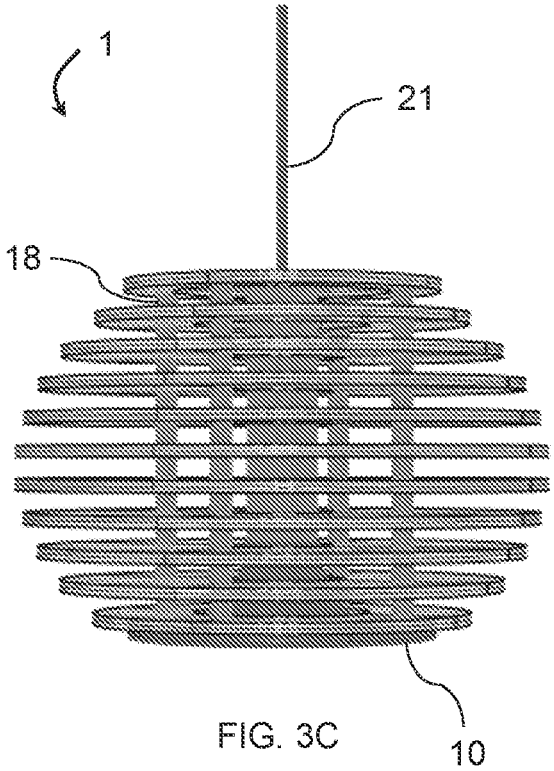
FIG. 3C shows a light fixture according to an embodiment of the present disclosure, wherein the light fixture body 2 comprises four pillars as supporting elements 18.
Figure 3D:
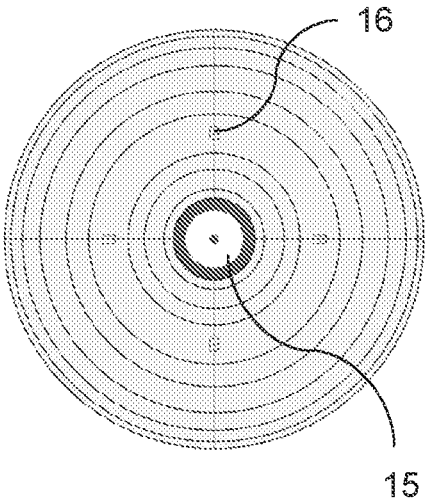
FIG. 3D shows a top view of the light fixture shown in FIG. 3C.

The light fixture body 2 should preferably be configured for receiving and/or accommodating the reflector 10 and the lamp fitting 6. The body of the light fixture may preferably be configured for receiving the reflector 10 from below. This may be achieved by having at least one opening 15 in at least a subset of the discs 12. Preferably, a plurality of the discs 12 in the set of discs comprise an opening 15 for receiving the lamp fitting 6. The opening 15 for receiving the lamp fitting 6 may be the same opening 15 for receiving the reflector 10. The opening 15 may be a central opening. As an example, all of the discs 12 may comprise at least one opening 15 for receiving a lamp fitting 6, such that the light fixture body 2 may accommodate the lamp fitting 6. A subset of the set of discs 12 may comprise a larger opening 15 for receiving the reflector 10 from below. In said subset, the size of the opening 15 may be larger at the bottom of the light fixture compared to the middle of the light fixture. In case of annular discs 12, the size of the opening 15 in the discs 12 is defined by the inner radius, $R_1$. The inner radius may be varied from disc to disc in the subset of discs 12, such that lower discs 12 have a larger inner radius than discs 12 located in the middle of the set of discs 12. The inner radius may be varied according to the shape of the reflector 10, such that the reflector 10 may be accommodated in the light fixture. For example, the reflector 10 may have a convex profile when viewed from below and it may further be rotationally symmetric. In case of such a reflector 10, the openings in the discs 12 may preferably be circular, and the inner radius varied according to a similar convex profile as the reflector 10 for approximately tracking the outer surface of the reflector 10. This is exemplified in the embodiments shown in FIG. 3A and FIG. 3C. However, the openings in the discs 12 may comprise all kinds of geometric shapes, e.g. square, elliptical, oval, hexagonal, or other geometries, in order to receive a particular reflector 10. Accordingly, it is preferred that the shape of the openings in the discs 12 are similar to the geometry of a horizontal cross-section of the reflector 10, which is intended for use in the light fixture. The openings are preferably located in the center of the discs 12, however they may be provided elsewhere. The set of discs 12 may also comprise a plurality of openings for receiving a plurality of lamp fittings and/or reflectors. This is illustrated in FIG. 6A-6D. Hence, the light fixture may comprise a plurality of lamp fittings and/or a plurality of reflectors. In other words, a plurality of lamps may be incorporated in one light fixture, wherein each lamp comprises a lamp fitting 6 and a reflector 10. A lamp may further comprise at least one light source.

The discs 12 may further be provided with a plurality of apertures 16 for receiving one or more supporting elements 18. As an example, each disc may be provided with a plurality of square apertures, each aperture configured for receiving a supporting element 18 such as a pillar.

Preferably, the discs 12 or a plurality of the discs 12 comprise a sound absorbing material 17 such that the light fixture body 2 is configured for absorbing sound energy from the surroundings. The discs 12 may comprise multiple layers of different materials. As an example, the discs 12 may comprise two layers, wherein one layer is considered a hard material, which provides structural support, and the other layer is considered a soft material or a sound absorbing material 17 for improving the acoustics of the light fixture. Accordingly, each disc may comprise two layers, wherein a first layer 13 is made of a material for providing structural support, and a second layer 14 is made of a sound absorbing material 17.

Set of Supporting Elements

The light fixture body 2 comprises a set of supporting elements 18 for holding the above-described discs 12. The supporting elements 18 should preferably be configured for ensuring the structural integrity of the light fixture body 2. As an example, the supporting elements 18 may be in the form of rods, either rigid or flexible, pillars, wires, or threads. The supporting elements 18 are preferably attached to the discs 12, for instance either mechanically or magnetically. Preferably, the supporting elements 18 ensure that the discs 12 are separated by a predetermined gap. This may be achieved by combining the supporting elements 18 with a plurality of fittings 20, such that the supporting elements 18 and the fittings 20 in combination provides a locking mechanism.

Figures 4A, 4B, 4C:
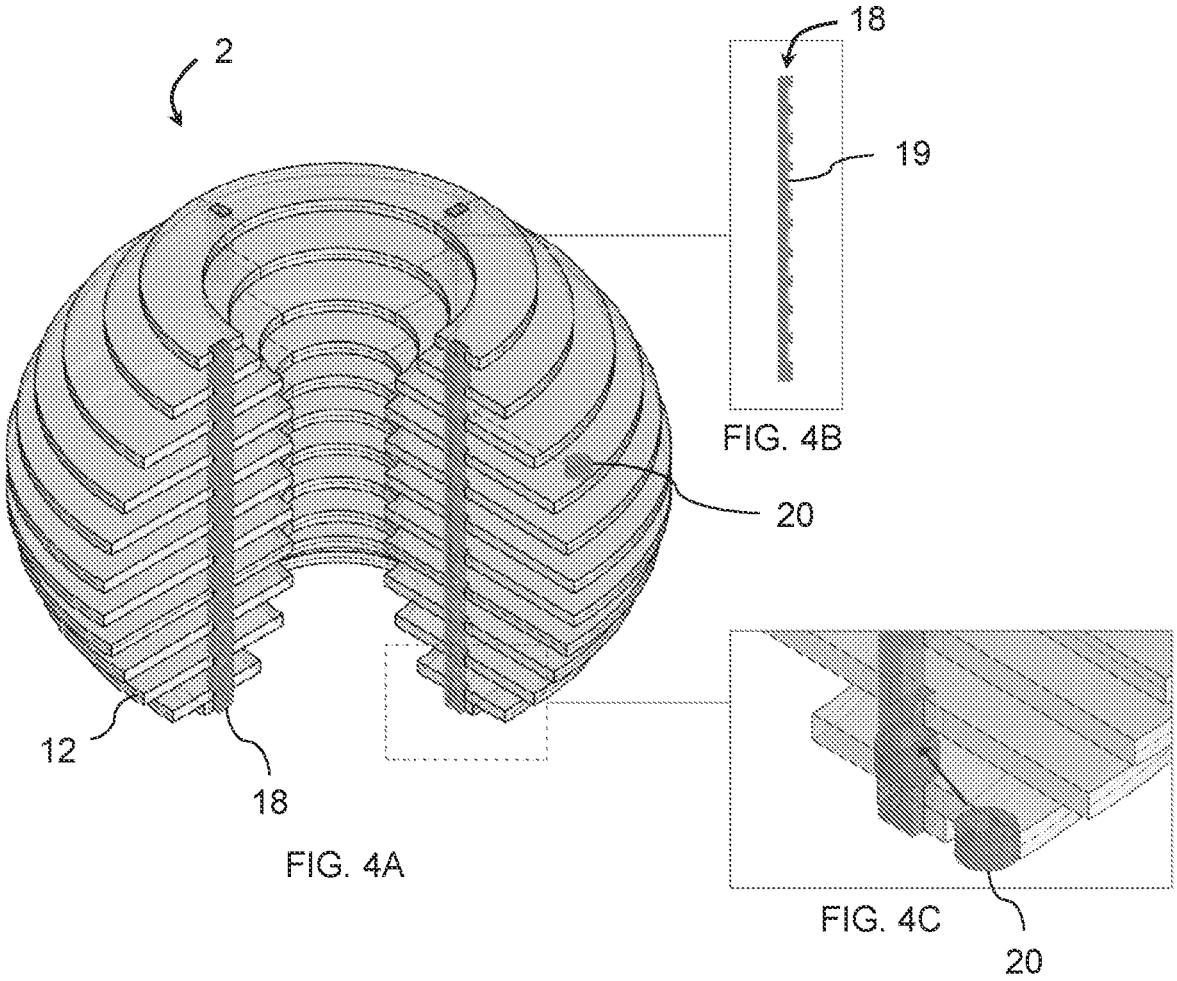
FIG. 4A shows a perspective view of a light fixture body 2 according to the present disclosure. In this view, approximately a quarter of the light fixture body 2 has been removed for illustrative purposes. The supporting elements 18 engage with the discs 12 and ensure a predefined gap between the discs 12.
FIG. 4B shows a schematic of a supporting element 18, here exemplified as a pillar with a plurality of notches 19. The pillar may be combined with a number of fittings 20.
FIG. 4C shows a fitting attached to a supporting element 18 in order to provide a locking mechanism. The light fixture body 2 may comprise a plurality of such locking mechanisms in order to provide structural support of the body and separate the discs 12.
Figure 5A:
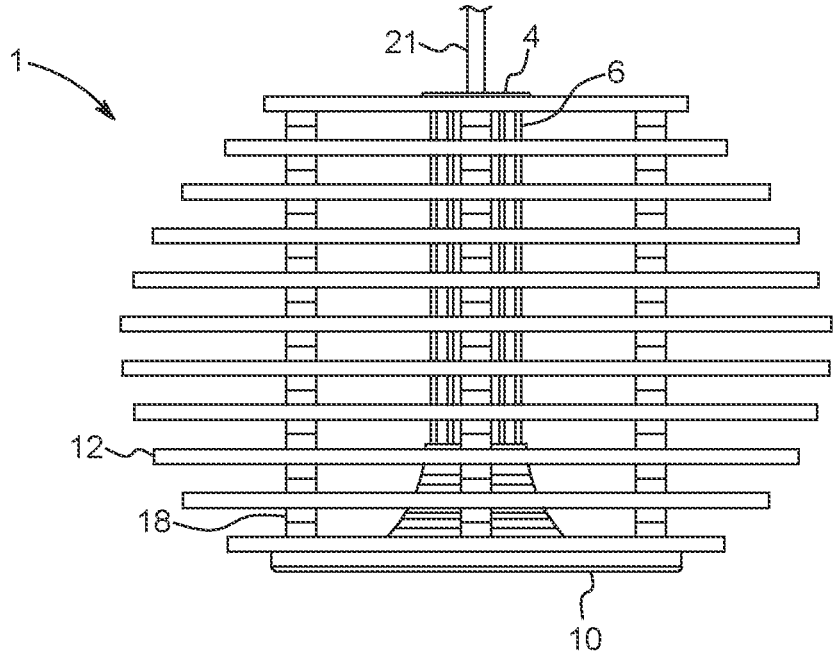
FIG. 5A shows a side-view of a light fixture 1 according to an embodiment of the present disclosure. In this view, the lamp fitting 6 is visible above the reflector 10.
Figure 5B:
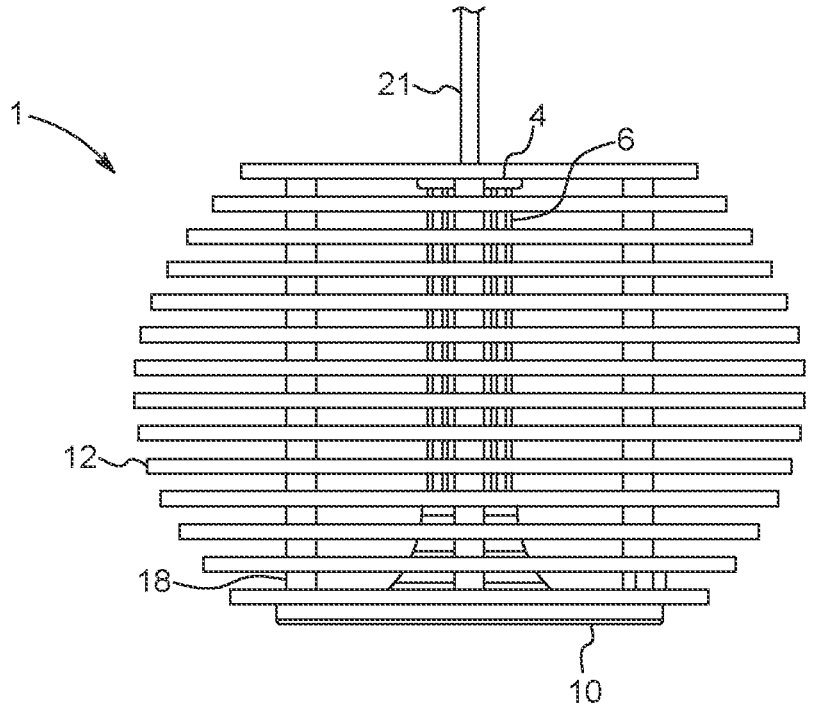
FIG. 5B shows a side-view of a light fixture 1 according to an embodiment of the present disclosure, wherein the light fixture body 2 comprises fourteen discs 12.

The set of supporting elements 18 may comprise a plurality of rigid pillars that are mechanically attached to the discs 12. The pillars may be provided with a plurality of notches 19 along the pillar. The notches 19 ensure that the discs 12 are separated by a predefined distance. The pillars may be combined with a number of fittings 20 that fit over the pillar and that may be used to lock the disc to the pillar. The fittings 20 may be used as spacers between the discs and/or they may be pressed into the discs for locking the disc to the pillar. This is illustrated in FIG. 4. As another example, the set of supporting elements 18 may comprise a plurality of wires that are mechanically attached to the discs 12.

The set of supporting elements 18 preferably comprises a plurality of supporting elements 18, such as 2-3 supporting elements 18, 4-6 supporting elements 18, or more than six supporting elements 18.

Light Fixture Body

The set of discs 12 and the set of supporting elements 18 may be assembled to form a light fixture body 2. The set of supporting elements 18 may be provided as pillars attached to the set of discs 12. The pillars may be mechanically fixed to the set of discs 12 using a plurality of fittings 20. The discs 12 may be provided in many different shapes and sizes as explained elsewhere; this variation may even be provided within one set of discs 12. Therefore, there are endless possibilities of 3-dimensional designs of the light fixture body 2. Some of these possibilities are illustrated in FIGS. 6A-6D. Consequently, the surface area of the light fixture body 2 may be adjusted by adjusting the size of the discs 12 and the number of discs 12 in the set of discs. Preferably, the light fixture body 2 has a large surface area, such as a surface area of at least 0.5 $m^2$, or at least 0.65 $m^2$, or at least 0.9 $m^2$, or at least 1.35 $m^2$. The light fixture according to the present disclosure will preferably have a surface area of at least 0.5 $m^2$ when it is provided as a downlight. When the light fixture is provided as a pendant it may have an even larger surface area, such as at least 1 $m^2$, or at least 1.3 $m^2$, or at least 1.8 $m^2$, or at least 2.5 $m^2$. The large surface area of the light fixture body 2 improves the ability to absorb a large amount of sound energy. This is in particular the case since the light fixture body 2 comprises a sound absorbing material 17. Preferably, a large part of the light fixture body 2 is made from such a material. For example, all the discs 12 in the set of discs may comprise a sound absorbing material 17. Alternatively, a plurality of the discs 12 and/or a plurality of the supporting elements 18 may comprise such a material.

Second Light Source

The light fixture may comprise a second light source 4 in addition to the first light source 3. Preferably, said second light source 4 is configured for distributing light through the gaps between the discs 12. In this case, the light fixture will facilitate a radial light distribution in addition to the light distributed primarily downwards by the first light source 3 in combination with the reflector 10.

The second light source may be configured for distributing light between the fins 7 of the lamp fitting 6. This may be achieved by placing the second light source 4 near the top of the lamp fitting 6. Therefore, the lamp fitting 6 is preferably configured for receiving a second light source 4 at a top section of the lamp fitting 6.

Figure 15:
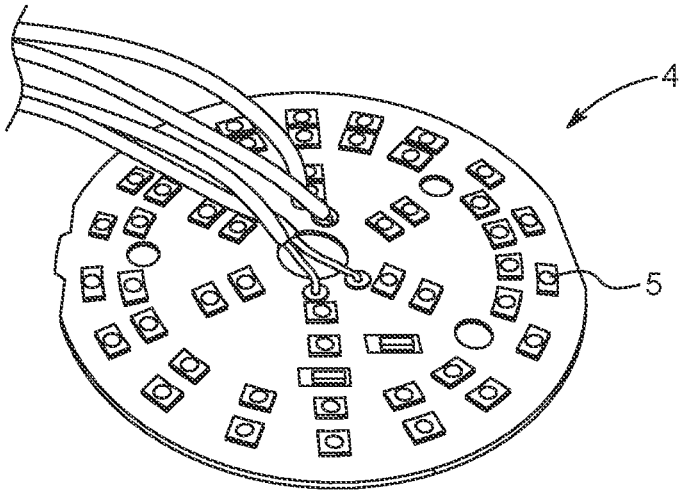
FIG. 15 shows an embodiment of a second light source 4, according to the present disclosure. This embodiment is an LED board comprising a plurality of LEDs 5.

The second light source 4 may be any light source suitable for the above-described purpose. The second light source 4 may be a light panel comprising a plurality of smaller light sources 5 such as light-emitting diodes (LEDs). As an example, the second light source 4 may be a circular LED board such as a printed circuit board (PCB) comprising a plurality of LEDs 5. Such an LED board according to the present disclosure is shown in FIG. 15. Another embodiment of a light panel is shown schematically in FIG. 16B.

Figure 16A:
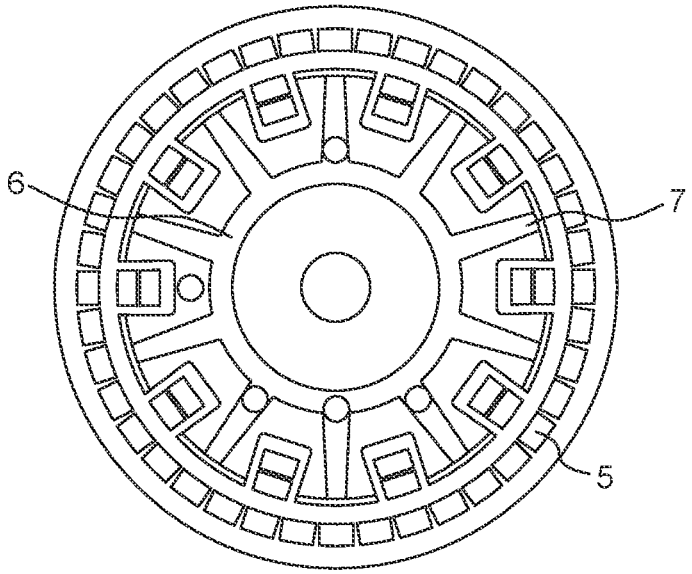
FIG. 16A shows schematically a top cross-sectional view of the second light source 4 placed on top of the lamp fitting 6. In this embodiment, the second light source 4 is an LED board comprising a plurality of LEDs 5.
Figure 16B:
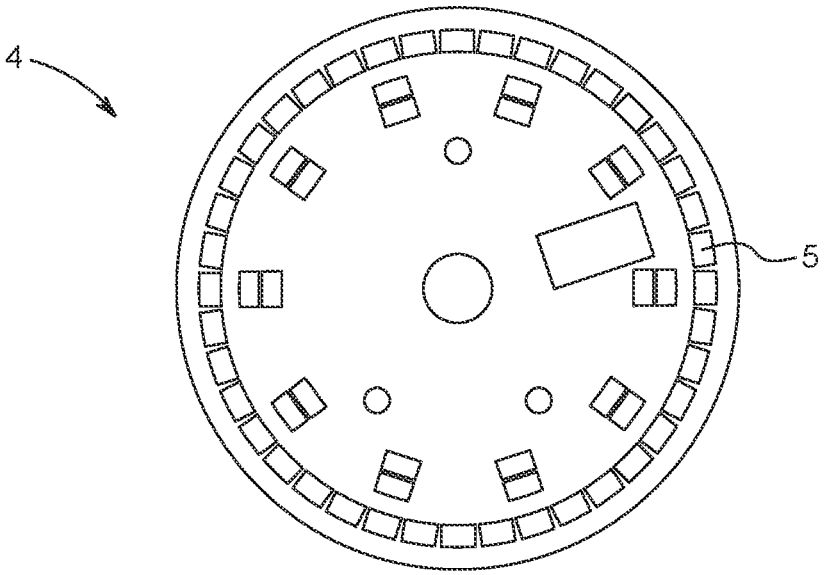
FIG. 16B shows a top view of the second light source 4 of FIG. 16A.

In case the second light source 4 is a light panel, a plurality of the light sources 5 on the panel may be selected to match the cross-sectional pattern of the cylindrical body and the fins 7 of the lamp fitting 6, such that light from the second light source 4 is emitted into the gaps between the fins 7. This is schematically shown in FIG. 16A, which shows a top cross-sectional view of the second light source 4 and the lamp fitting 6. In this embodiment, the lamp fitting 6 comprises a hollow cylindrical body and ten radially extending fins 7. The second light source 4 comprises an LED board with a plurality of light-emitting diodes 5 arranged circumferentially underneath the board and in between the fins 7 of the lamp fitting 6 in order to provide light 360° around the lamp fitting 6.

The lamp fitting 6 and the second light source 4 may be attached to each other mechanically or magnetically. The provision of a second light source 4 facilitates a radial light distribution through the gaps between the discs 12 of the light fixture.

Sound Absorbing Material

The light fixture body 2 comprises a sound absorbing material 17. The sound absorbing material 17 is understood to be a material suitable for use as a sound absorber, i.e. for absorbing sound energy from the surroundings. Examples of sound absorbing materials include high-density fiberglass, fibrous materials, open-celled foams, acoustic foams, polyester, acoustic cotton batts, acoustic mineral wool, cork, recycled denim, or eelgrass. Any part of the light fixture body 2 may comprise a sound absorbing material 17. Preferably, the discs 12 or at least a plurality of the discs 12 comprise a sound absorbing material 17.

Preferred Embodiment

According to a preferred embodiment, the light fixture is a pendant suitable for being suspended from a ceiling 23. The pendant largely resembles a compressed sphere, cf. FIG. 1. The light fixture body 2 of the pendant comprises a plurality of annular discs 12, each disc having a central opening 15 for receiving a lamp fitting 6. The central openings are circular and defined by an inner radius, $R_1$. An outer radius, $R_2$, which is measured from a central vertical axis to the outer edge of the disc, defines the outer edge of the annular discs 12. A subset of the discs 12 are configured for receiving the reflector 10 from below as previously described. In this embodiment, the two discs 12 located in the bottom comprise a larger central opening 15 than the discs 12 located in the middle of the light fixture. Hence, the inner radius for these discs 12 are larger such that the reflector 10 may be received from below. Preferably, the light fixture may accommodate the reflector 10 such that only a small part of the reflector 10, e.g. the bottom edge, protrudes below the light fixture. This is the case of many of the embodiments, for example the one illustrated in FIG. 3C.

Regarding the preferred embodiment, the pendant comprises a plurality of discs 12 that are arranged to form a 3-dimensional light fixture body 2, wherein there is a predefined vertical gap between each consecutive disc in the set of discs 12. The discs 12 comprise a plurality of first apertures 16 in addition to the central openings, such that the discs 12 may receive a plurality of supporting elements 18 through said apertures 16. The apertures 16 may have any shape such as rectangular, circular, or polygonal. The discs 12 are connected by said supporting elements 18 in the form of rigid pillars. This embodiment comprises at least three pillars, preferably three to four pillars. The pillars engage with the discs 12 via the aforementioned apertures 16 in the discs 12. Furthermore, the pillars comprise a plurality of notches 19, wherein the amount of notches 19 correspond to the number of gaps between the discs 12. Thus, in case of eleven discs 12, each pillar comprises ten notches 19. Furthermore, a plurality of fittings 20 are provided, the fittings 20 being configured for mechanically engaging with the pillars in order to provide a locking mechanism that mechanically locks each disc to the pillar. The fittings 20 are designed to fit over the pillars, such that the fittings 20 are positioned in each notch of the pillar. Thus, when the light fixture body 2 is assembled, the fittings 20 ensure that there is a predefined gap between the discs 12. The size of the gap may be predefined by varying the length of each notch in the pillar. Accordingly, the gap size may vary among the discs 12 in the set of discs. However, in this embodiment the gap is maintained equal between each consecutive disc in the set of discs 12.

Regarding the preferred embodiment, the light fixture further comprises a lamp fitting 6 configured for receiving a first light source 3. The lamp fitting 6 may be of the type disclosed in WO 2014/053145 by the same applicant. The light fixture further comprises a lamp fitting 6 comprising a plurality of radially extending fins 7. The preferred embodiment comprises a second light source 4 placed at the top of the light fixture as shown in FIG. 1, wherein said light source is configured such that light from the second light source 4 is emitted into the gaps between the fins. This is schematically shown in FIG. 16A. In this embodiment, the second light source 4 is an LED board comprising a plurality of LEDs 5.

The preferred embodiment is illustrated in FIGS. 1-5 with minor variations. The embodiments shown in FIGS. 1-5A comprise 11 discs 12. The embodiment shown in FIG. 5B comprise 14 discs 12. FIG. 3A shows a pendant comprising three pillars, and FIG. 3C shows a pendant comprising four pillars.

Second Embodiment

Figure 6A:
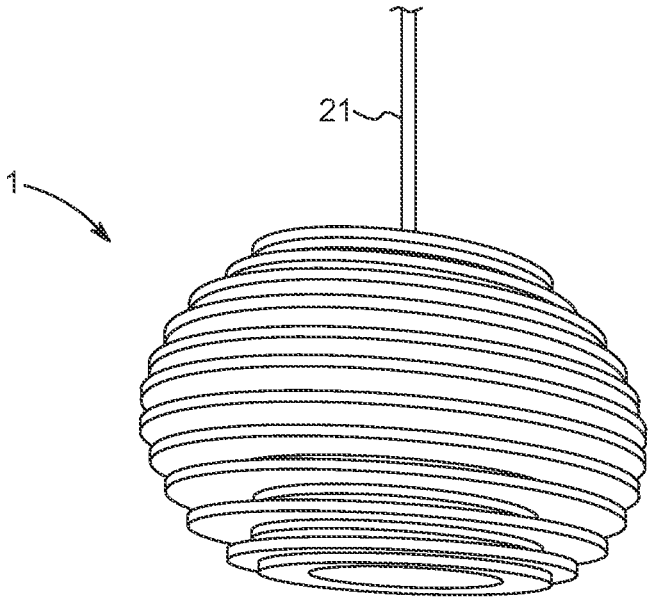
FIG. 6A shows a light fixture 1 according to an embodiment of the present disclosure, wherein the light fixture body 2 has an elongated shape such as an oval shape.

The second embodiment is largely similar to the preferred embodiment with the exception of the shape of the discs 12 and the shape of the reflector 10. The second embodiment comprises the same features as described in relation to the preferred embodiment. However, this embodiment features annular discs 12 that are oval in shape, and a reflector 10 with an oval horizontal cross-section. In other words, the discs 12 and the reflector 10 are oval when viewed directly from below. This embodiment is illustrated in FIG. 6A.

Third Embodiment

Figure 6B:
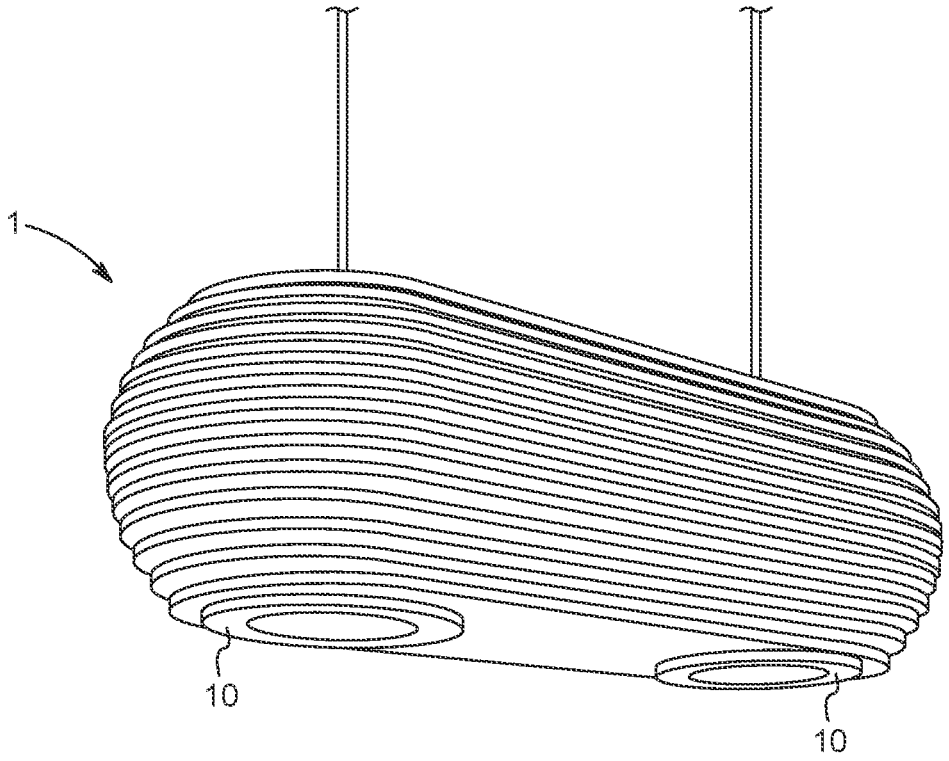
FIG. 6B shows a light fixture 1 according to an embodiment of the present disclosure, wherein the light fixture body 2 has an elongated shape and wherein the light fixture comprises two reflectors and two lamp fittings, such that two lamps are provided in one light fixture.

The third embodiment is largely similar to the preferred embodiment. Thus, it comprises similar features with the exception of the shape of the discs 12 and the amount of openings in the discs 12. Consequently, the overall design of the light fixture may be varied by varying the size and shape of the discs 12 constituting the light fixture body 2. This embodiment features at least two pairs of lamp fittings and reflectors, each pair comprising a lamp fitting 6 and a reflector 10 that are connected. An example is shown in FIG. 6B, which shows a light fixture that appears to be two spherical pendants connected by a straight middle section.

Fourth Embodiment

Figure 6C:
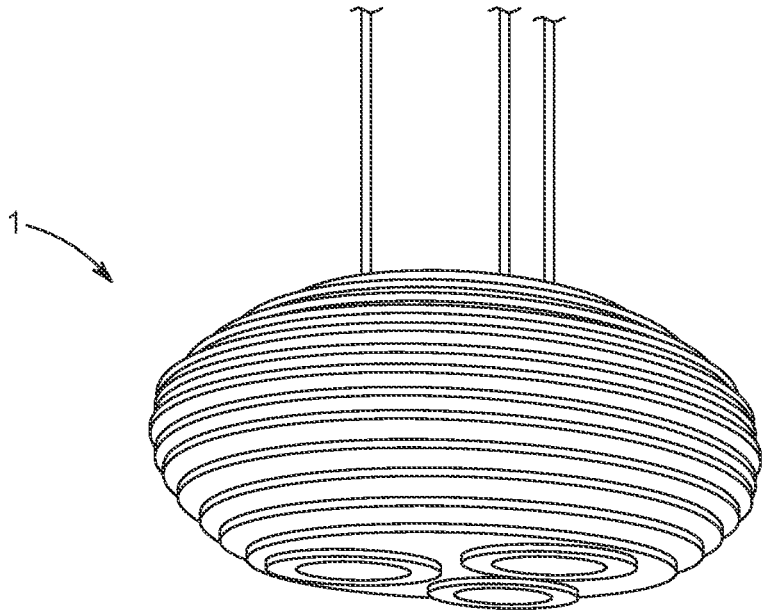
FIG. 6C shows a light fixture 1 according to an embodiment of the present disclosure, wherein the light fixture comprises three reflectors and three lamp fittings, such that three lamps are provided in one light fixture.
Figure 6D:
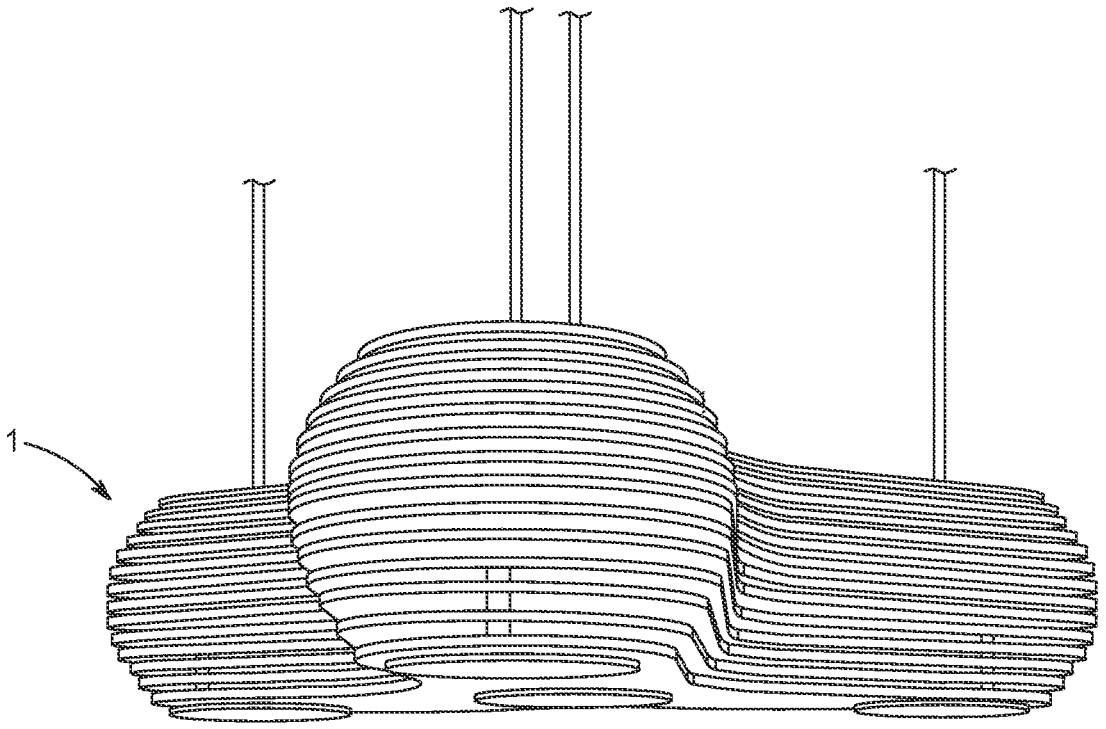
FIG. 6D shows a light fixture 1 according to an embodiment of the present disclosure, wherein the light fixture comprises four reflectors and four lamp fittings, such that four lamps are provided in one light fixture. The light fixture has a multi-lobe structure.

The fourth embodiment is largely similar to the preferred embodiment. Thus, it comprises similar features with the exception of the shape of the discs 12 and the amount of openings in the discs 12. This embodiment comprises a set of discs 12, each disc comprising at least three openings, each opening 15 configured for receiving a lamp fitting 6 and a reflector 10. Thus, the embodiment may accommodate at least three lamp fittings and three reflectors. The shape of the discs 12 may be of arbitrary shape, but an example is shown in FIG. 6C, which shows a pendant with three reflectors. Another example is shown in FIG. 6D, which shows a pendant with a multi-lobe structure, each lobe housing a lamp fitting 6 and a reflector 10. The multi-lobe structure features a central part, which also may accommodate a lamp fitting 6 and a reflector 10 as shown in FIG. 6D.

Fifth Embodiment

Figure 10A:
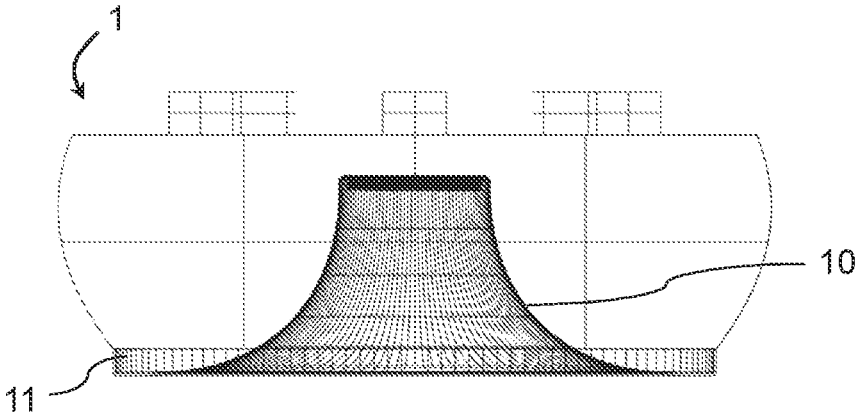
FIG. 10A-10E show in cross-section various embodiments of a light fixture 1 according to the present disclosure. Each embodiment has a different amount of discs 12 and/or a different size of the discs 12, in order to achieve various surface areas of the light fixture body 2.
Figure 10B:
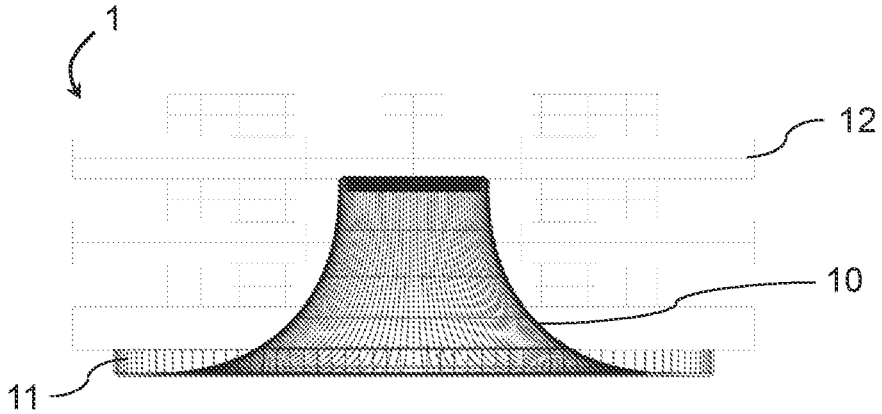
Figure 10C:
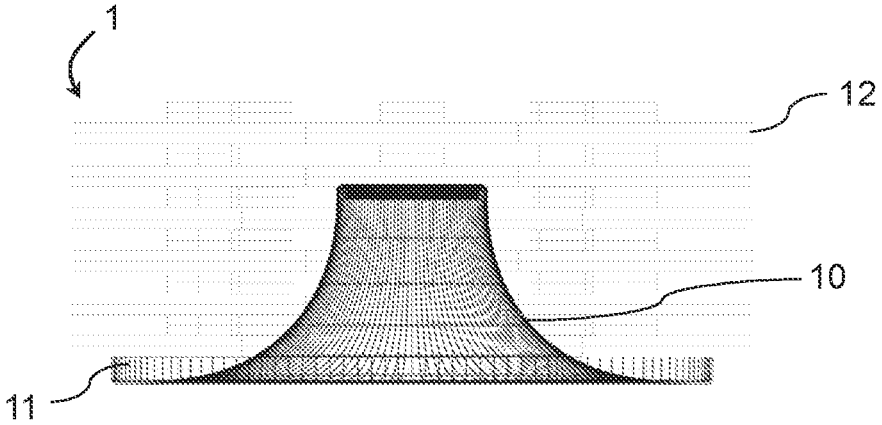
Figure 10D:
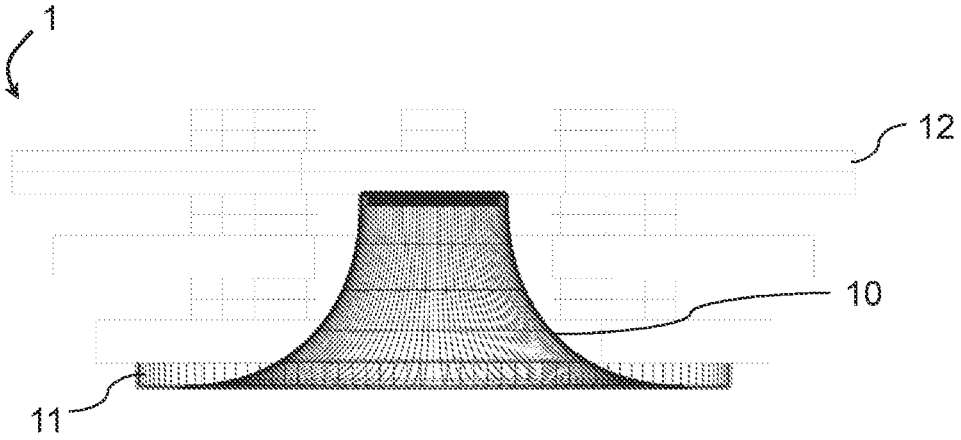
Figure 10E:
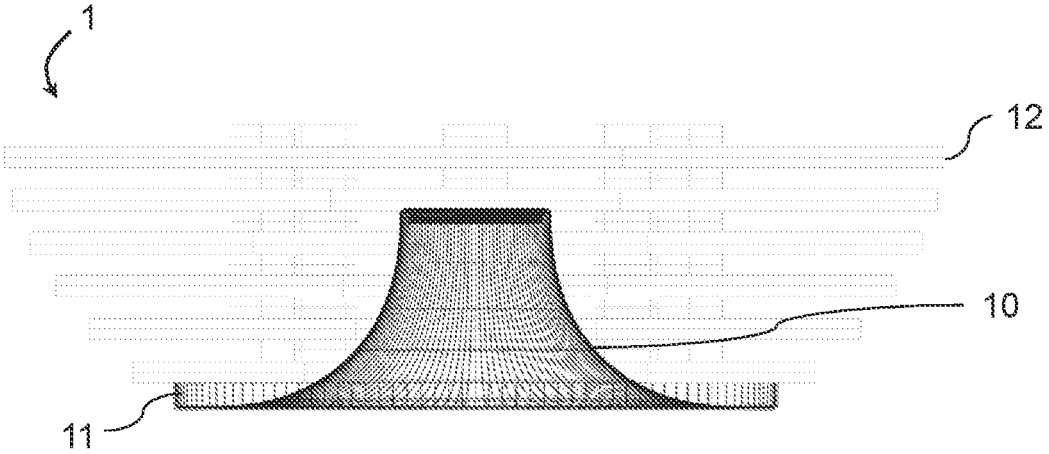
Figure 11A:
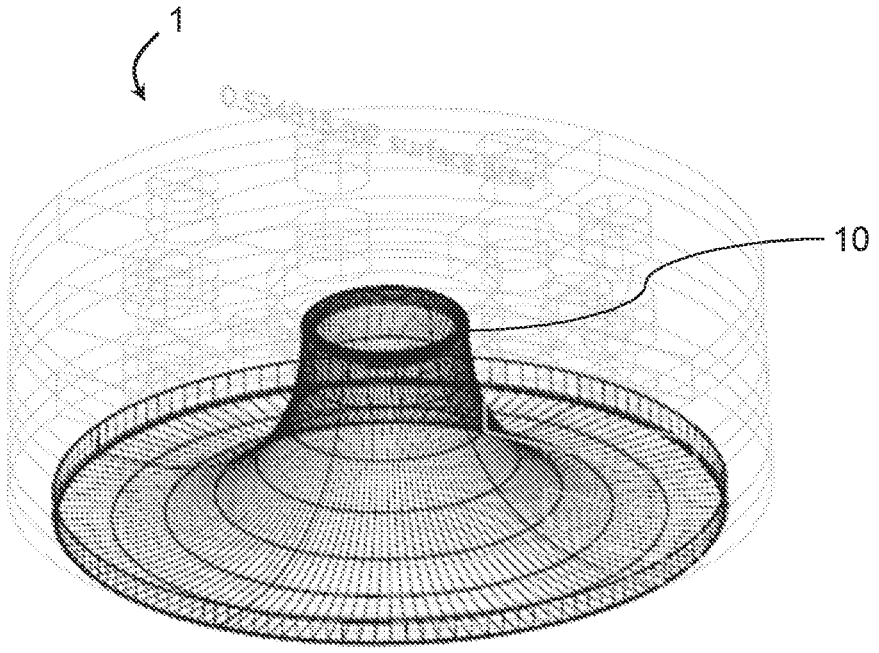
FIG. 11A-11B show in perspective two embodiments of a light fixture 1 according to the present disclosure, wherein the outer radius of the discs 12 are maintained constant throughout the set of discs 12 in order to achieve straight outer edges. The two embodiments comprise a different amount of discs 12.
Figure 11B:
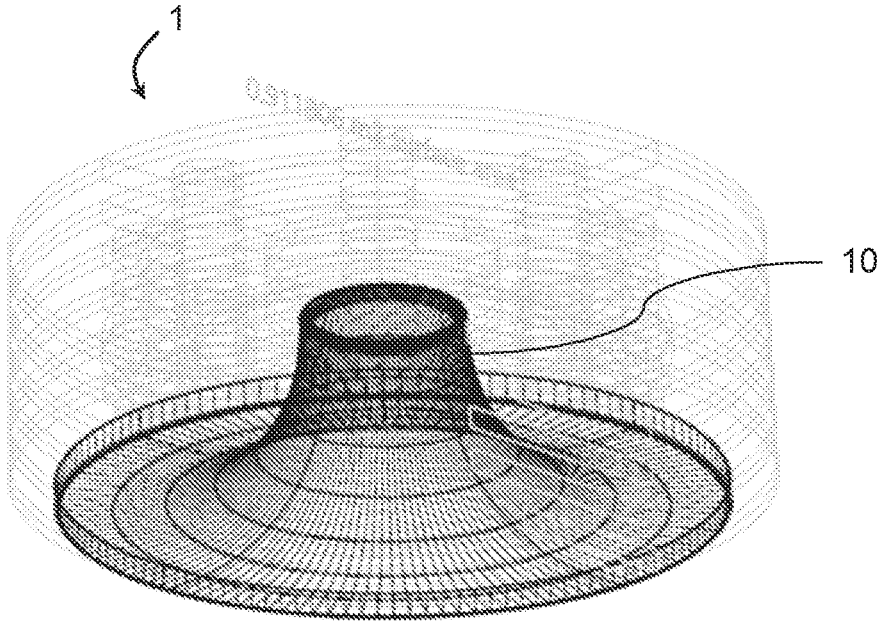
Figure 13A:
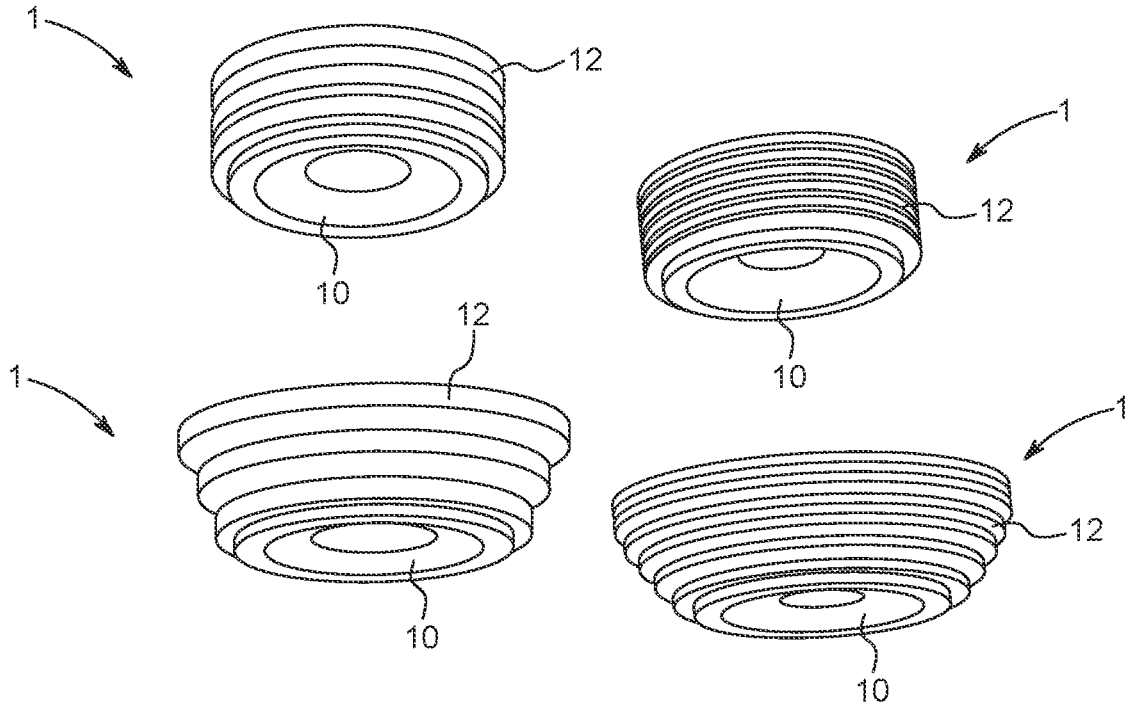
FIG. 13A-13B show in perspective various embodiments of a light fixture 1 according to the present disclosure.
Figure 13B:
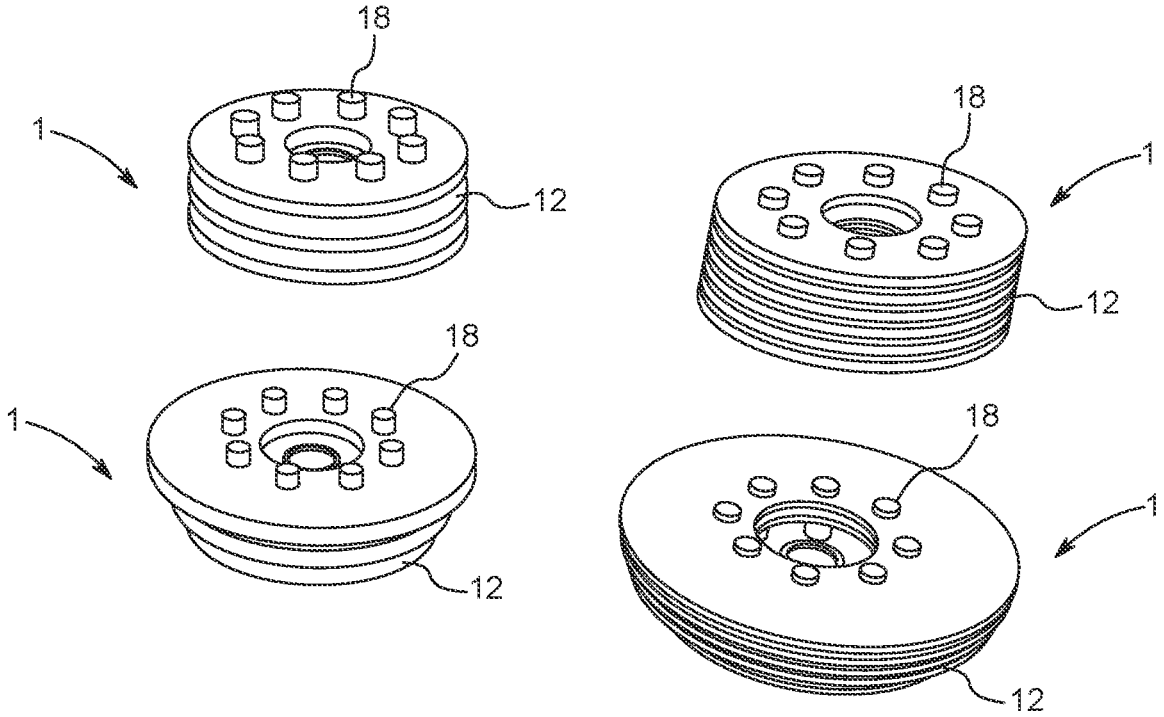

The fifth embodiment of the light fixture is a downlight, i.e. a surface-mounted light fixture that is placed in close proximity to a ceiling 23, preferably in contact with a ceiling 23. Similar to the pendant, the downlight comprises a light fixture body 2 comprising a set of discs 12 and a set of supporting elements 18 as previously described. The downlight also comprises a reflector 10 and a lamp fitting 6. The number of discs 12 and the size of the discs 12 may be varied such that the surface area of the light fixture body 2 may be adjusted to a specific value. In general, a larger number of discs 12 imply a larger surface area. This is illustrated by the embodiments shown in FIGS. 13B-10E, which show a downlight in vertical cross-section.

Second Aspect

In another aspect, the present disclosure relates to a light fixture that is suitable for retro-fitting to an existing lamp housing 22 which is flush mounted or countersunk into an opening of a ceiling 23 or interior surface of a building. Such a light fixture is described in PCT/EP2019/075532 by the same applicant, which is hereby enclosed by reference in its entirety. The light fixture described in said application is a modular lighting device primarily intended as a downlight. The light fixture according to the second aspect is shown in various embodiments in FIGS. 7A-9E. Note that these embodiments do not necessarily comprise a set of discs 12 as explained in relation to the first aspect.

Figure 7A:
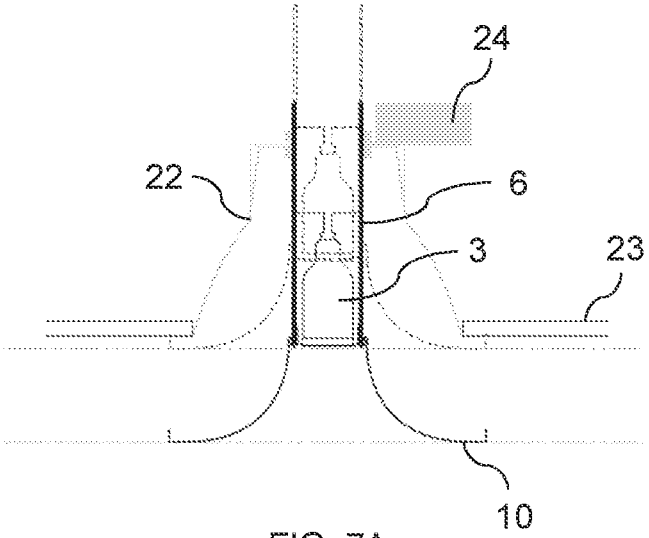
FIG. 7A shows a light fixture 1 according to an embodiment of the present disclosure. This embodiment is suitable for use as a retro-fit to an existing lamp housing 22. This figure illustrates how the reflector 10 may be lowered relative to the ceiling 23 in order to fit a sound absorbing material 17 between the reflector 10 and the ceiling 23.
Figure 7B:
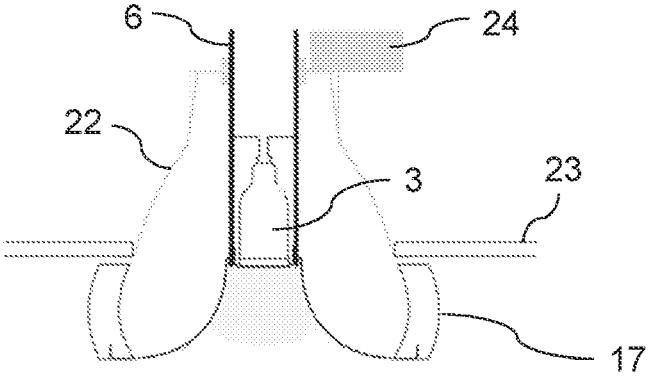
FIG. 7B shows the light fixture 1 of FIG. 7A, wherein a sound absorbing material 17 has been provided between the upper side of the reflector 10 and the lower side of the ceiling 23. The figure further illustrates how the reflector 10 directs the light from the first light source 3 primarily downwards.
Figure 7C:
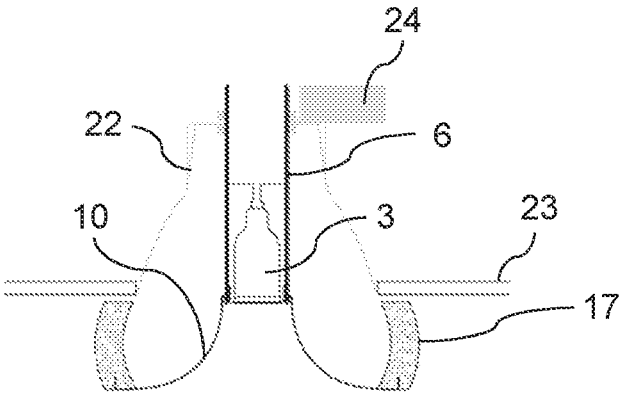
FIG. 7C shows the light fixture 1 of FIG. 7A, wherein a sound absorbing material 17 has been provided between the upper side of the reflector 10 and the lower side of the ceiling 23. The figure further illustrates how an incoming sound wave is reflected by the convex shape of the sound absorber. Another part of the energy is absorbed in the material.
Figure 8A:
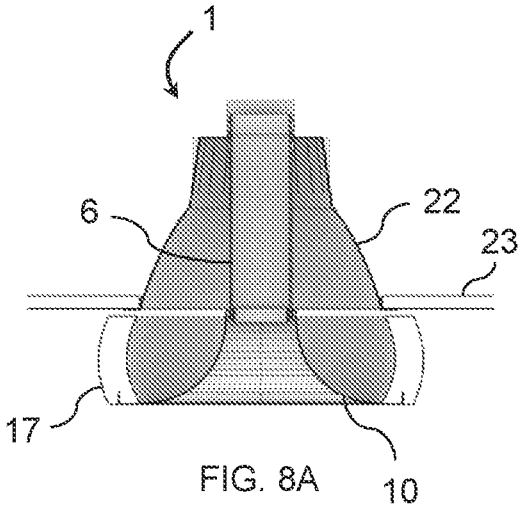
FIG. 8A-8F show various embodiments of a light fixture 1 comprising a sound absorbing material 17. These embodiments are suitable for use as a retro-fit to an existing lamp housing 22. They are largely similar except for the shape of the sound absorbing material 17.
Figure 8B:
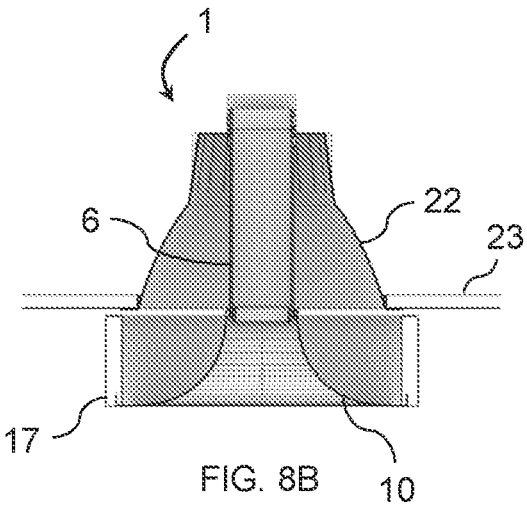
Figure 8C:
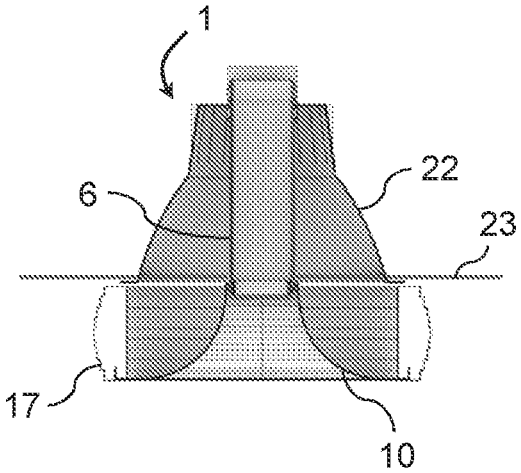
Figure 8D:
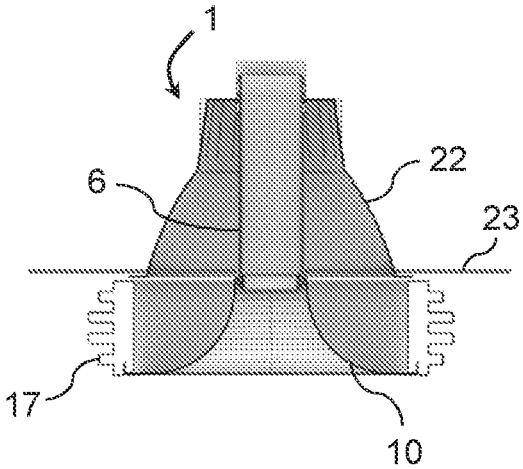
Figure 8E:
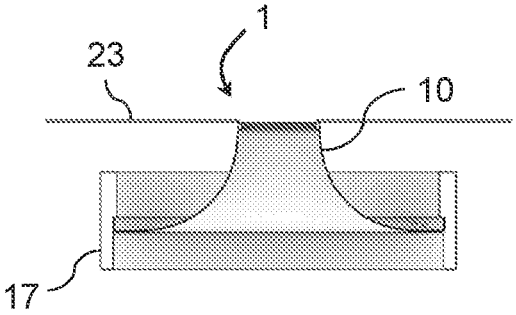
Figure 8F:
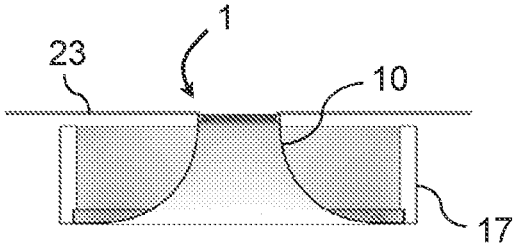
Figure 9A:
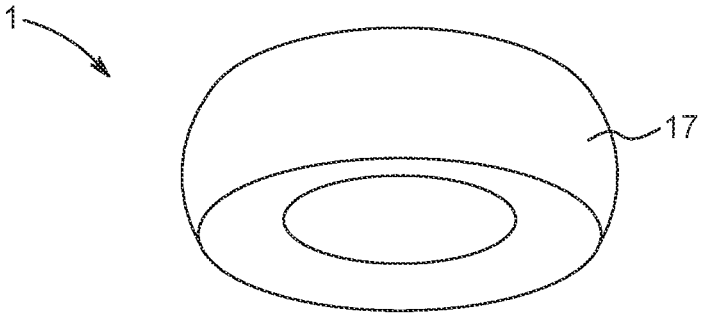
FIG. 9A-9E show in perspective various embodiments of a light fixture 1 comprising a sound absorbing material 17.
Figure 9B:
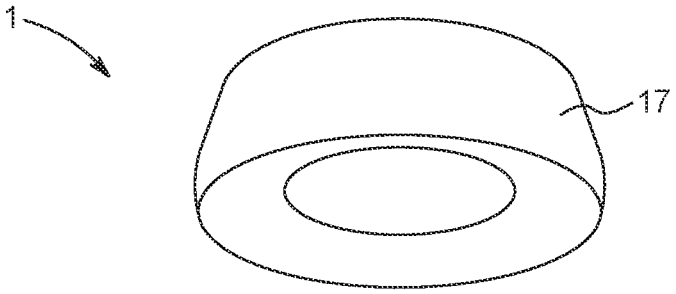
Figure 9C:
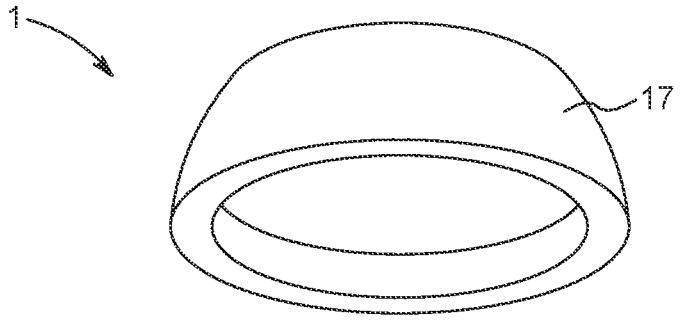
Figure 9D:
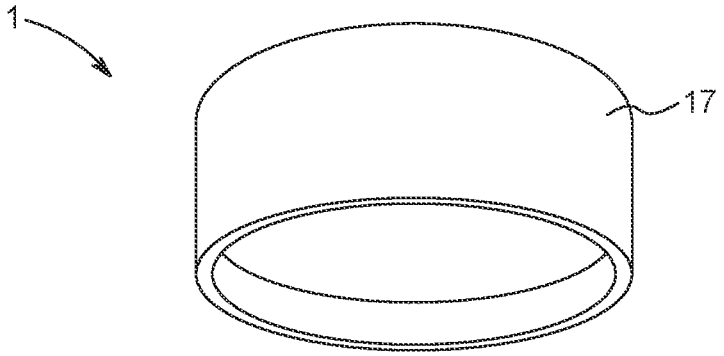
Figure 9E:
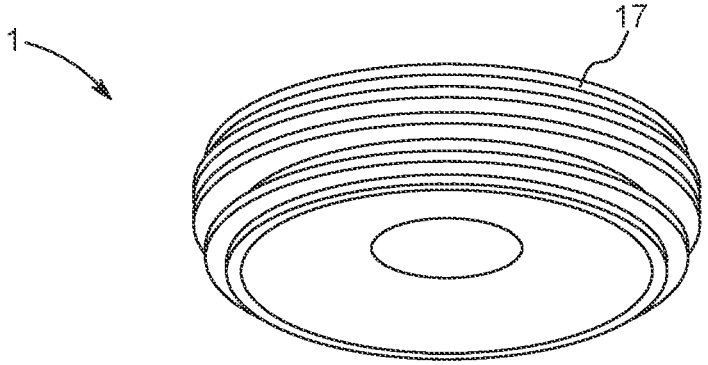

The light fixture according to the second aspect comprises a lamp fitting 6 configured for receiving a light source and configured for attachment to an existing lamp housing 22. It further comprises a reflector 10 for reflecting and/or modifying light from the light source, the reflector 10 comprising a narrow top section configured for attachment to said lamp fitting 6. The reflector 10 has a wider bottom section for covering an opening in a ceiling 23, wherein the existing lamp housing 22 is installed. Preferably, the reflector 10 is configured for engagement with the lamp fitting 6 and further configured for axial adjustment of the position of the reflector 10 relative to the lamp fitting 6 in order to accommodate different sized lamp housings. The light fixture further comprises a sound absorbing material 17, similar to the light fixture according to the first aspect. The sound absorbing material 17 may preferably be fitted between the reflector 10 and the wall/ceiling 23 as shown in FIGS. 7A-7C and FIGS. 8A-8F. The extra distance between the reflector 10 and the ceiling 23 may be accomplished by lowering the reflector 10 and/or the lamp fitting 6 relative to the lamp housing 22, e.g. by using an extension element as disclosed in PCT/EP2019/075532. Alternatively, the extra distance may be realised by providing a long lamp fitting 6. The sound absorbing material 17 may have various shapes and sizes for reflecting or redirecting sound waves as shown in FIGS. 7A-7C. It preferably extends along the entire circumference of the reflector 10 of the light fixture as shown in FIGS. 9A-9E. The upper edge of the sound absorbing material 17 may be in contact with the surface of the wall/ceiling 23 and the lower edge may follow the rim 11 of the reflector 10. Alternatively, the lower edge may protrude below the reflector 10 as seen on FIG. 12C-12D. The sound absorbing material 17 may be shaped using a variety of methods such as milling, upholstery, moulding, or stacking of individual layers. The sound absorbing material 17 shown in FIG. 7C has a convex shape such that part of the incident sound waves are redirected away from the source and another part of the energy is absorbed in the material. This contributes to a pleasant sound environment in proximity to the lamp device.

Assembly Kit

The present disclosure further relates to an assembly kit comprising a set of supporting elements 18 and a set of discs 12, which may be assembled to form a light fixture. In one embodiment, the assembly kit may be used to assemble the light fixture body 2 of a pendant wherein the outer surface of the pendant is shaped predominantly as a compressed sphere. The supporting elements 18 may be in the form of pillars as described elsewhere. Furthermore, the assembly kit may comprise a plurality of fittings 20 for providing a locking mechanism in combination with the pillars and discs 12.

Further Details of the Invention

1. A light fixture for absorbing sound energy, the light fixture comprising:
   - a lamp fitting 6 configured for receiving a first light source 3;
   - a reflector 10 for reflecting and/or modifying light from the first light source 3, the reflector 10 comprising a top section configured for attachment to the lamp fitting 6; and
   - a body comprising:
     - i. a set of discs 12, each disc having at least one opening 15 therein for receiving the lamp fitting 6; and
     - ii. a set of supporting elements 18 configured for holding the set of discs 12 such that the set of discs 12 are separated by a predefined gap.
   - wherein at least one of the discs 12 and/or one of the supporting elements 18 comprise a sound absorbing material 17.
2. The light fixture according to item 1, wherein the lamp fitting 6 is configured for receiving a second light source 4.
3. The light fixture according to any of the preceding items, wherein the lamp fitting 6 comprises a cylindrical body.
4. The light fixture according to any of the preceding items, wherein the lamp fitting 6 comprises an outer thread on at least a part of the outer surface.
5. The light fixture according to any of the preceding items, wherein the lamp fitting 6 comprises an outer thread on a majority of the outer surface.
6. The light fixture according to any of the preceding items, wherein the lamp fitting 6 is configured for threaded engagement with the reflector 10.
7. The light fixture according to any of the preceding items, wherein the lamp fitting 6 comprises a plurality of radially extending fins 7.
8. The light fixture according to any of the preceding items, wherein the lamp fitting 6 comprises a plurality of apertures.
9. The light fixture according to any of the preceding items, wherein the body of the light fixture is configured for receiving the reflector 10 from below.

10. The light fixture according to any of the preceding items, wherein the opening 15 of at least a subset of the discs 12, is configured for receiving the reflector 10 from below.
11. The light fixture according to any of the preceding items, wherein the size of the opening 15 of the discs 12 contained in said subset is varied among each disc according to the outer profile of the reflector 10, such that the light fixture may accommodate the reflector 10.
12. The light fixture according to any of the preceding items, wherein the set of discs 12 comprises a plurality of openings, such that the light fixture may comprise a plurality of lamp fittings and/or a plurality of reflectors.
13. The light fixture according to any of the preceding items, wherein the light fixture comprises a plurality of lamp fittings and/or a plurality of reflectors.
14. The light fixture according to any of the preceding items, wherein the discs (12) are annular discs, each disc defined by an inner circumference and an outer circumference, the inner circumference defining an opening (15) in the disc, wherein said opening is configured for receiving the reflector (10) from below.
15. The light fixture according to any of the preceding items, wherein the discs 12 are annular discs 12, each disc defined by a first radius and a second radius, the first radius defining a central circular opening 15 in the disc.
16. The light fixture according to any of the preceding items, wherein the outer radius is varied such that the edges of the discs 12 follow a convex shape when the light fixture is viewed in cross-section.
17. The light fixture according to any of the preceding items, wherein the outer radius is varied such that at least a part of the outer surface of the light fixture resembles a sphere.
18. The light fixture according to any of the preceding items, wherein the bottom part of the lamp-fitting and the top section of the reflector 10 are configured for threaded engagement.
19. The light fixture according to any of the preceding items, wherein at least a part of the shape of the reflector 10 is convex when viewed from below.
20. The light fixture according to any of the preceding items, wherein the light fixture is a pendant light.
21. The light fixture according to any of the preceding items, wherein the light fixture is a downlight.
22. The light fixture according to any of the preceding items, wherein the set of discs 12 comprises at least three discs 12.
23. The light fixture according to any of the preceding items, wherein the set of discs 12 comprises at least six discs 12.
24. The light fixture according to any of the preceding items, wherein the body has a surface area of at least 0.5 $m^2$.
25. The light fixture according to any of the preceding items, wherein the body has a surface area of at least 1 $m^2$.
26. The light fixture according to any of the preceding items, wherein the light fixture further comprises a second light source 4.
27. The light fixture according to any of the preceding items, wherein the second light source 4 is configured for distributing light out through the gap between the discs 12.
28. The light fixture according to any of the preceding items, wherein the second light source 4 comprises a light panel comprising a plurality of light sources 5 such as light-emitting diodes (LEDs).
29. The light fixture according to any of the preceding items, wherein the second light source 4 is a circular LED board.
30. The light fixture according to any of the preceding items, wherein each disc comprises two layers of different materials, wherein one of said materials is a sound absorbing material 17.
31. The light fixture according to any of the preceding items, wherein the set of supporting elements 18 comprise pillars attached to the set of discs 12.
32. The light fixture according to any of the preceding items, wherein the pillars are mechanically fixed to the set of discs 12 using a plurality of fittings 20.
33. The light fixture according to any of the preceding items, wherein the set of supporting elements 18 comprise wires attached to the set of discs 12.

REFERENCE NUMERALS

1. Light fixture
2. Light fixture body
3. First light source
4. Second light source
5. Light sources
6. Lamp fitting
7. Fins
8. Inner thread
9. Outer thread
10. Reflector
11. Rim
12. Discs
13. First layer
14. Second layer
15. Opening
16. First apertures
17. Sound absorbing material
18. Supporting elements
19. Notches
20. Fittings
21. Chord
22. Lamp housing
23. Ceiling
24. LED driver

The invention claimed is:

1. A light fixture for absorbing sound energy, the light fixture comprising:
- a lamp fitting configured for receiving a first light source;
- a reflector for reflecting light from the first light source, the reflector comprising a top section configured for attachment to a bottom section of the lamp fitting; and
- a body comprising:
  - a set of discs, wherein a plurality of the discs have at least one opening configured for receiving the lamp fitting; and
  - a set of supporting elements configured for holding the set of discs such that the set of discs are separated by a predefined gap;
- wherein at least one of the discs and/or one of the supporting elements comprise a sound absorbing material.

2. The light fixture according to claim 1, wherein the discs are annular discs, each disc defined by an inner circumference and an outer circumference, the inner circumference defining the opening in the disc, wherein said opening is configured for receiving the reflector from below.

3. The light fixture according to claim 2, wherein the size of the opening of at least a subset of the discs is varied among each disc according to the outer profile of the reflector.

4. The light fixture according to claim 1, wherein the supporting elements comprise pillars attached to the set of discs.

5. The light fixture according to claim 1, wherein the pillars comprise a plurality of notches specifying a predefined gap between the discs.

6. The light fixture according to claim 1, wherein the supporting elements are mechanically fixed to the set of discs using a plurality of fittings.

7. The light fixture according to claim 1, wherein the bottom part of the lamp fitting and the top section of the reflector are configured for threaded engagement.

8. The light fixture according to claim 1, wherein the lamp fitting comprises a cylindrical body with a plurality of fins extending radially from said body.

9. The light fixture according to claim 1, wherein the lamp fitting is configured for receiving a second light source at a top section of the lamp fitting.

10. The light fixture according to claim 9, wherein the light fixture is configured such that light from the second light source is distributed through the gaps between the discs.

11. The light fixture according to claim 10, wherein the second light source comprises a light panel comprising a plurality of light sources such as light-emitting diodes (LEDs).

12. The light fixture according to claim 11, wherein the lamp fitting comprises a cylindrical body with a plurality of fins extending radially from said body, and wherein the location of the plurality of light sources on the panel is selected to match the cross-sectional pattern of the cylindrical body and the fins such that light from the second light source is emitted into the gaps between the fins.

13. The light fixture according to claim 1, wherein each disc comprises two layers, wherein a first layer is made of a material for providing structural support, and a second layer is made of a sound absorbing material.

14. The light fixture according to claim 1, wherein the light fixture comprises a plurality of lamps, each lamp comprising a lamp fitting configured for receiving a first light source and a reflector attached to said lamp fitting.

15. The light fixture according to claim 1, wherein the light fixture is a pendant light.

16. A light fixture body comprising:

a set of discs, wherein a plurality of the discs have at least one opening configured for receiving a lamp fitting; and a set of supporting elements configured for holding the set of discs such that the set of discs are separated by a predefined gap;

wherein at least one of the discs and/or one of the supporting elements comprise a sound absorbing material.

17. The light fixture according to claim 16, wherein the discs are annular discs, each disc defined by an inner circumference and an outer circumference, the inner circumference defining the opening in the disc, wherein said opening is configured for receiving the reflector from below.

18. The light fixture according to claim 16, wherein the supporting elements comprise pillars attached to the set of discs.

19. The light fixture according to claim 18, wherein the pillars comprise a plurality of notches specifying a predefined gap between the discs.

20. The light fixture according to claim 16, wherein the supporting elements are mechanically fixed to the set of discs using a plurality of fittings.

* * * * *